US005980440A

United States Patent [19]

Mitman et al.

[11] Patent Number: 5,980,440

[45] Date of Patent: Nov. 9, 1999

[54] CARTON FORMING

[75] Inventors: David W. Mitman, Atglen; Thomas L. Holder, Downingtown, both of Pa.

[73] Assignee: McGuckin & Pyle, Inc., Downingtown, Pa.

[21] Appl. No.: 08/857,761

[22] Filed: May 15, 1997

[51] Int. Cl.[6] ..... B31B 1/00; B31B 13/00

[52] U.S. Cl. ..... 493/52; 493/55; 493/128; 493/131; 493/141; 493/151

[58] Field of Search ..... 493/52, 55, 128, 493/131, 132, 141, 150, 151, 243, 246, 477, 140

[56] References Cited

U.S. PATENT DOCUMENTS

| | | | |
|---|---|---|---|
| 1,037,372 | 9/1912 | Upton et al. . | |
| 2,049,417 | 8/1936 | Barbieri . | |
| 2,105,582 | 1/1938 | Butler . | |
| 2,480,177 | 8/1949 | Zinn, Jr. et al. . | |
| 2,547,899 | 4/1951 | Zinn, Jr. . | |
| 2,746,626 | 5/1956 | Vantlander et al. . | |
| 3,000,275 | 9/1961 | Sevison . | |
| 3,207,049 | 9/1965 | Monroe et al. . | |
| 3,382,775 | 5/1968 | Allen . | |
| 3,648,573 | 3/1972 | Le Febvre et al. . | |
| 3,748,972 | 7/1973 | Barton | 493/128 |
| 3,782,071 | 1/1974 | Hagedorn . | |
| 4,036,117 | 7/1977 | Davies et al. . | |
| 4,133,254 | 1/1979 | Odom et al. | 493/128 |
| 4,289,491 | 9/1981 | Collur et al. | 493/132 |
| 4,439,174 | 3/1984 | Derderian | 493/131 |
| 4,861,325 | 8/1989 | DiMarzio et al. . | |
| 4,932,930 | 6/1990 | Coalier et al. | 493/128 |

*Primary Examiner*—Eugene L. Kim
*Attorney, Agent, or Firm*—Synnestvedt & Lechner LLP

[57] ABSTRACT

Cartons are formed from die cut carton blanks two at a time from two feed magazines each holding a stack of carton blanks, two adhesive application means having optical sensors for sensing adhesive application to the carton blanks, a centrally mounted rotary table having prefolding means which engage and prefold tabs on the carton blanks, folding means comprising apertures interengaging the blanks and forming the cartons therefrom, two transfer means for transferring carton blanks from the feed magazines to the rotary table, two reciprocating forming rams cooperatively associated with the folding means on the rotary table and effecting the formation of cartons thereon, means for holding the formed cartons in their final shape while the adhesive sets, a computer with resident software for coordinating and synchronizing the operation of the above listed components to form cartons, the software receiving feedback signals from the various components and issuing commands depending on the nature of said feedback signals.

6 Claims, 19 Drawing Sheets

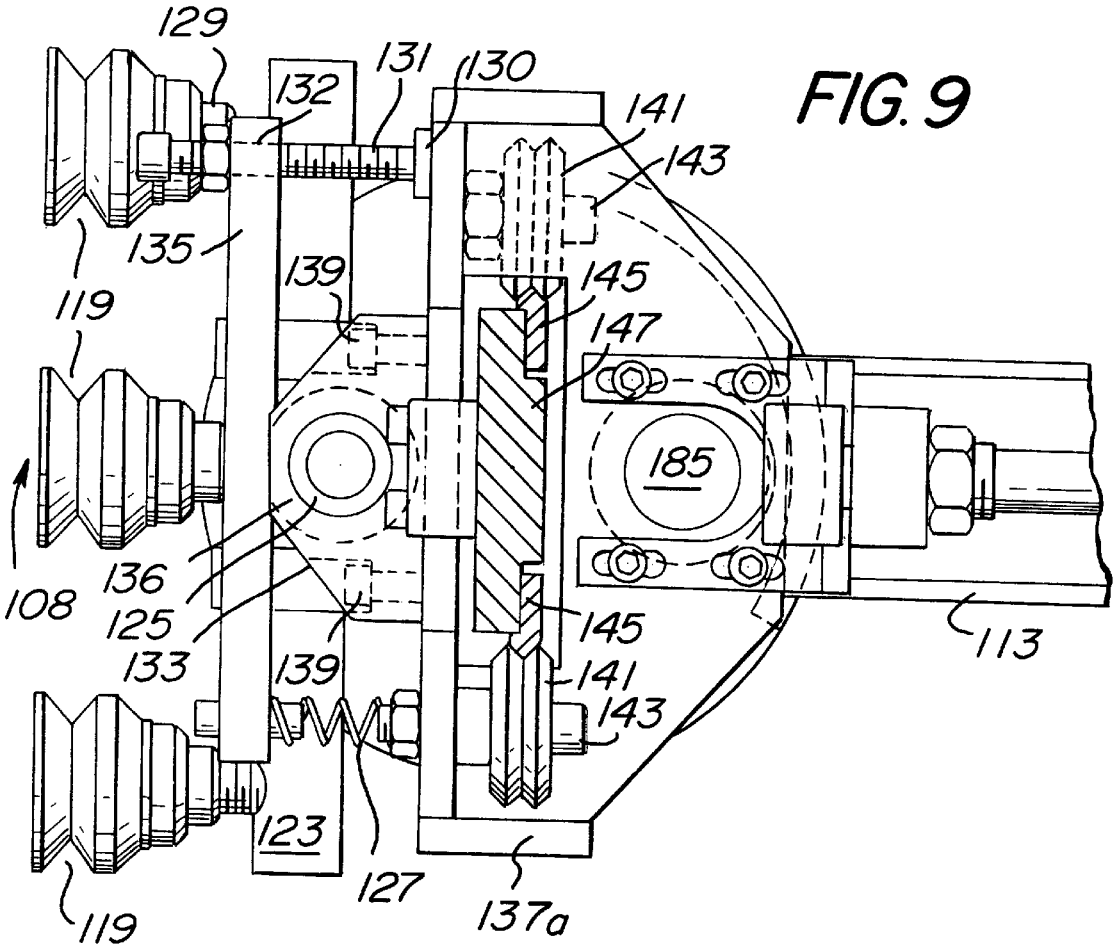
FIG. 9
FIG. 10
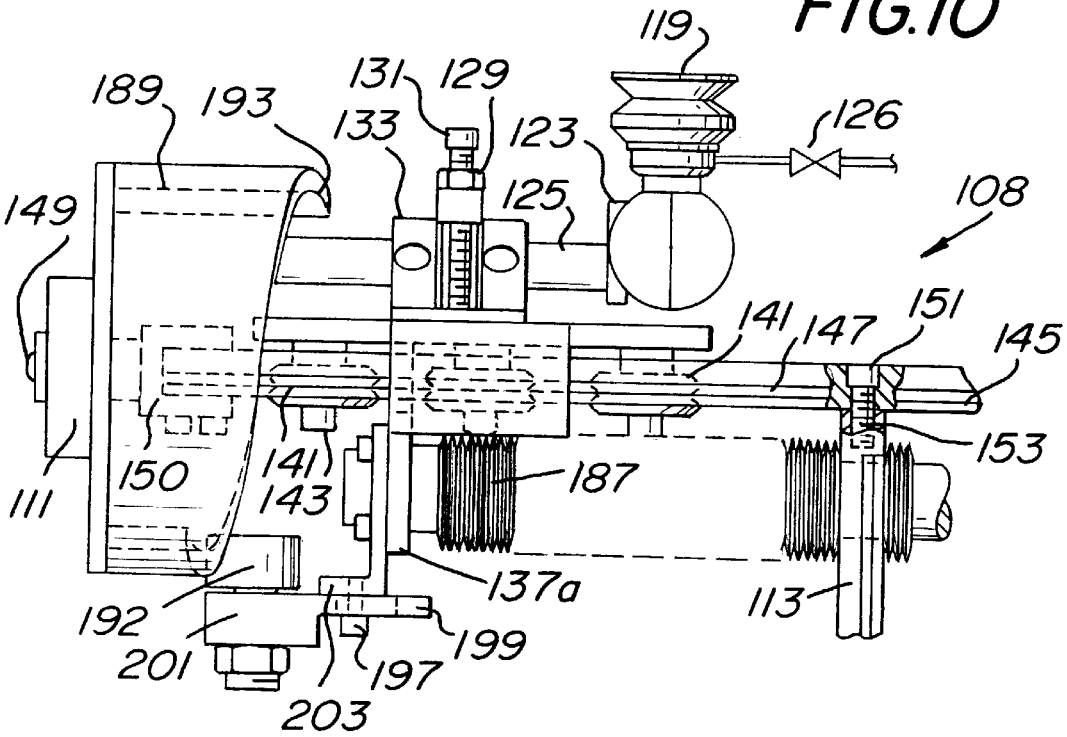

6
161
167
165
171
169
163
165
159
157
115
155
155
105
204
206
4
201
113
192
137a
189
111
173
175
31
3
41
21
108
41
31
4
3
40
39
34
5
23
17
9

161
165
163
171
169
165
105
6
113
159
157
155
189
137a
108
204
115
155
201
192
111
206
21
173
175
4
3
31
41
41
31
40
39
4
3
5
23
17
34
9

161
167
165
163
171
169
165
105
137a
21
108
189
149
159
113
192
115
201
155
111
204
206
4
173
175
31
41
41
31
40
39
4
3
3
5
17
34
9
6

104
106
204
206
210a
212
214
216
218
220
221
222
223
224
225
226
227
228
229
231
233
234
235
236
237
238
239
240
241
242
243
244
245
246
247
250
252
18
19

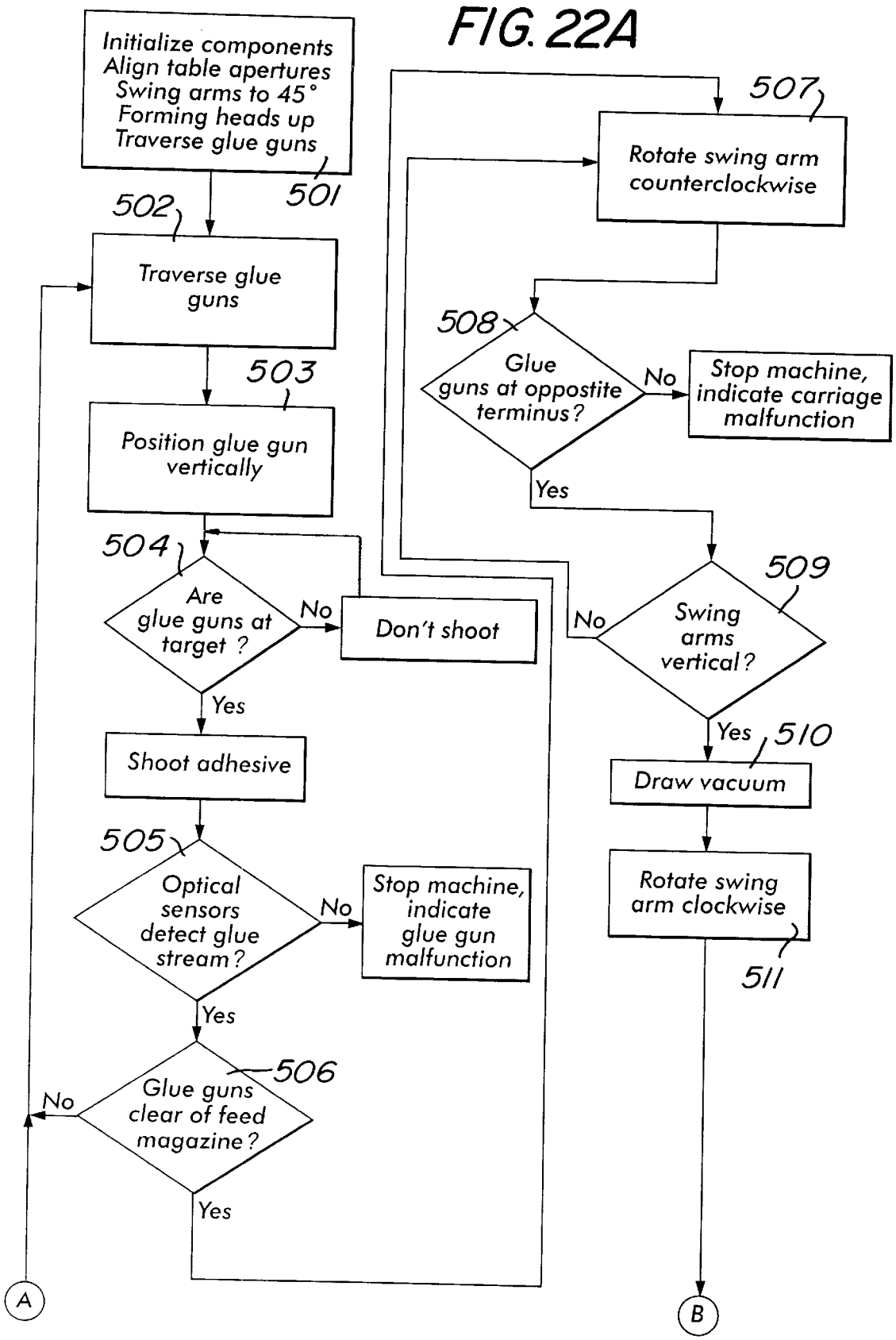
FIG. 22A
Initialize components
Align table apertures
Swing arms to 45°
Forming heads up
Traverse glue guns
501
502
Traverse glue guns
503
Position glue gun vertically
504
Are glue guns at target ?
No
Don't shoot
Yes
Shoot adhesive
505
Optical sensors detect glue stream?
No
Stop machine, indicate glue gun malfunction
Yes
506
Glue guns clear of feed magazine?
No
Yes
A
507
Rotate swing arm counterclockwise
508
Glue guns at oppostite terminus?
No
Stop machine, indicate carriage malfunction
Yes
509
Swing arms vertical?
No
Yes
510
Draw vacuum
Rotate swing arm clockwise
511
B

CARTON FORMING

FIELD OF THE INVENTION

This invention relates to an apparatus for forming cartons from precut carton blanks by folding the blanks along predetermined fold lines thus forming side walls and overlapping mating regions which are adhesively secured thereby fixing the carton form.

BACKGROUND OF THE INVENTION

Cartons of various sizes, shapes and types, made from various materials, are important throughout commerce and industry in applications too numerous to catalog. One particular example is the food service industry, where such containers are routinely used by the millions to package prepared foods, such as hamburgers, french fries and the like, for convenient handling and transport prior to consumption.

Given the vast demand for such cartons it is imperative that they be produced cheaply, quickly and reliably, while minimizing the need for inspection of the finished product. Due to the further demand for continuously changing carton designs involving different sizes, shapes, features and materials, it is also important that a machine which manufactures such items be readily adaptable to manufacture the new designs and accommodate different materials and features. Finally, the machine itself should be of simple construction, easy to operate and maintain, operate reliably and have a minimum of moving parts.

Although carton fabrication machines have been long in existence, they have generally not satisfied the aforementioned objectives, especially with regard to versatility or simplicity of construction. U.S. Pat. No. 4,861,325 to DiMarzio et al, for example, describes a carton forming machine with distinct limitations imposed on the machine's adaptability to different carton designs. A change to a new carton design might require different adhesive application points. For the DiMarzio machine such a change would entail extensive reconfiguration of the adhesive application system, requiring new parts and significant down time while the machine is rebuilt to handle the new cartons. Similarly, a new carton might require a change in the timing and coordination of the various moving parts of the machine. The DiMarzio machine makes no provision for readily changing the timing, all the moving parts are rigidly synchronized by a single control cam and various linkages and associated followers. Timing changes would entail extensive redesign of the cam and the linkages, requiring essentially a new machine.

The machine disclosed in U.S. Pat. No. 3,648,573 to LeFebvre et al suffers the same problems as the DiMarzio machine and, in addition, is exceedingly complex. The LeFebvre machine has many moving parts such as the belt transfer means, pinch belts, pinch rollers, nip rolls and idler rollers, all of which typically require adjustment, lubrication, inspection and replacement for wear. Of particular complexity is the endless cam track actuating multiple cam follower rods held in a series of bifurcated arms which rotate synchronously with a rotary table. Such complexity leaves significant room for improvement in the state of the art, as is displayed in the present development.

SUMMARY OF OBJECTS OF THE INVENTION

The machine is constructed around a rigid frame, typically of tubular steel construction. Preferably twin feed magazines are arranged on opposite sides of the frame. The feed magazines each hold a stack of precut carton blanks and each supply the blanks to the machine, one at a time. The carton blanks are foldable along predetermined lines defining a bottom and side walls which comprise the carton when folded. The blanks are not limited to this particular carton configuration and could, for example, be of the "clamshell" type, in which the carton has sidewalls, a top and a bottom joined by an integral hinge. Typically, the carton blank material is preferably corrugated cardboard, although other suitable materials such as regular cardboard, plastic and the like could be used as well. The carton blanks also have adhesive receiving regions and corresponding mating regions which interengage when the carton is folded, the glue setting and holding the carton in its shape.

The feed magazines present the carton blanks to the adhesive application means. There are preferably two such means, each cooperating with a respective feed magazine. Each adhesive application means comprises preferably two adhesive projecting means comprising applicators in the form of glue guns or glue nozzles which are mounted on respective traversing means and direct a stream of adhesive onto predetermined locations on the carton blanks. Preferably, the glue guns are mounted on a vertically oriented pulley belt actuated by an air cylinder which allows for the precise vertical positioning of each glue gun in proximity to the adhesive receiving regions of the carton blanks for the application of glue. The vertical pulley belt rides on a carriage capable of horizontal motion, preferably actuated by a motor driven ball screw. A ball nut affixed to the carriage engages the screw and the carriage is moved horizontally in either direction proportionally to screw rotation. The vertical and horizontal mobility of the traversing means allows for adhesive to be placed accurately over a wide range of locations on a carton blank, thus accommodating a potentially wide variety of carton designs.

Preferably, optical sensors ride on the pulley belt with the glue guns. The sensors detect adhesive application by projecting a beam of light which reflects from the projected glue stream and is detected by the sensor. The sensor beam is preferably oriented to detect both the presence or absence of the glue stream at a particular location, thus giving an indication not only of glue application but of glue application to a particular location.

The glue guns are preferably capable of dispensing varying amounts of adhesive as needed for a particular application on a particular adhesive receiving region of a blank. Dispensed adhesive amounts can range from a small dot to a continuous line of adhesive applied to a blank. It has been recognized in the art that repeated applications of dots of adhesive tend to clog the glue gun but application of a line of adhesive tends to clear the gun and avoid a clogging malfunction. Therefore, in a preferred operating mode of the machine, the regions requiring adhesive dots will be applied before the regions requiring lines of adhesive. This mode of operation will ensure relatively clog free operation of the adhesive application means as the glue guns will be cleared after each application of adhesive.

Preferably the machine has two transfer means each of which engages a respective carton blank after adhesive application. Each traversing means moves the respective glue guns away from a respective blank allowing each transfer means to engage an adhesive applied blank. Each transfer means is actuated by a motor and preferably comprises a pivoting vacuum head mounted on a reciprocating swing arm. The swing arms rotate 90° from the horizontal to the vertical, the suction heads simultaneously pivoting in an opposite sense also through 90° at which point the suction heads each preferably engage a respective blank. Preferably, the suction heads on each swing arm are divided into two groups and are capable of relative motion toward and away from each other. This is accomplished preferably by a cam and cam follower arrangement and biasing spring, the camming action forcing the heads together during swing arm rotation in one direction and biasing spring compression forcing the heads apart upon rotation in the opposite direction. Such capability is of advantage if a "clamshell" type carton is to be produced, the relative motion of the suction heads serving to fold and form the clamshell hinge by forcing the top and bottom portions of the carton together during transfer means operation. Preferably also, the suction heads are adjustable to afford precise engagement of a carton blank.

The transfer means moves adhesive applied carton blanks from a stack in each respective feed magazine to a respective carton blank folding means. The carton blank folding means is preferably formed by apertures extending through a support table. The apertures have side walls dimensioned to engage and fold the side walls of the blank deposited thereon by the transfer means. Preferably, preforming means are also mounted to the support table adjacent to the apertures. The preforming means preferably have projecting members which engage the adhesive receiving regions and the respective mating regions on the blank and bring these regions into alignment prior to blank folding by the folding means. The preforming means are preferably adjustable to ensure proper engagement with said mating regions. In addition, carton blank retaining means are also mounted on the support table around the apertures. The retaining means preferably comprise threaded studs and angle brackets projecting upwardly from the table which are positioned to intrude into and engage the periphery of a carton blank deposited on the support table, exerting a retaining force by compressing the blank in the horizontal plane.

Preferably, the table is movable to bring each carton blank into alignment with a respective forming station. Preferably, there are two such stations, each with a carton forming ram. The rams execute reciprocal motion each actuated by a common motor. The rams preferably have forming heads which engage respective cartons, forcing the cartons into a respective aperture to effect folding.

The forming rams can preferably operate to discharge the folded cartons from the apertures, preferably into an adhesive setting means comprising a bottomless cage or chamber of vertically aligned members dimensioned to receive the folded cartons, contact and exert pressure against the side walls of each carton and hold them in the folded position against their natural tendency to unfold. Preferably, the cartons remain in the setting means long enough for the adhesive to set and hold the carton in its functional shape.

The various moving parts of the machine are controlled and coordinated by a control means, preferably a computer system and associated software. The computer and its software are preferably capable of transmitting signals to the machine causing the transfer means, the adhesive application means including the traversing means and the adhesive applicators, the carton forming rams and the support table to operate. The software program preferably performs a coordinating function by synchronizing the operations of the machine components. Preferably, the software program can receive inputs from the various machine components proportional to the status of said components. Typically, inputs such as the positions of the transferring means, the positions of the forming rams, the positions of the glue guns and the actuation of the glue guns are used by the software program to operate the machine to efficiently produce the cartons.

In operation, the machine, preferably controlled by the computer system and the associated software, simultaneously applies adhesive to adhesive receiving regions on two precut carton blanks held in the two feed magazines. Adhesive is applied by means of the glue guns which traverse the surface of the blanks and deposit adhesive where required. Preferably the guns move horizontally to clear the blanks after the adhesive application step and allow the two transfer means to remove each adhesive applied blank from its feed magazine, perform a folding operation to form a clamshell hinge (if required) and place the box blanks into registry with the forming apertures in the support table. Preforming means on the table engage and prefold adhesive receiving and mating regions on the carton blanks, retaining means engage the carton blank periphery, holding the blank in position. The table moves to bring each carton blank under a respective forming ram. Preferably, additional empty apertures on the table are simultaneously presented to the transfer means to accept the next pair of box blanks. The two forming heads, which are in constant motion, are synchronized to move downwardly when the motion of the table brings the carton blanks under the forming rams. The rams engage the carton blanks on the downward stroke, preferably forcing the blanks through the apertures and folding the blanks into a carton. Preferably the ram causes the cartons to be discharged into the setting means where the formed boxes nest in the boxes formed in the previous machine cycle and the setting means holds the folded carton in its functional shape while the adhesive sets.

It is an object of the invention to provide a machine for forming cartons which is relatively inexpensive to build, simple to operate and reliable in operation.

It is a further object of the invention to provide a machine for forming cartons which is versatile and adaptable to easily accommodate different carton designs, different carton features and different carton materials with a minimum of reconfiguration and machine down time.

It is another object of the invention to provide a machine for forming cartons reliably at sustained high rates of production while maintaining product quality and obviating the need for frequent product inspection.

BRIEF DESCRIPTION OF THE DRAWINGS

FIG. 9 is a sectional view taken along line 9—9 of FIG. 8 showing a detail of vacuum head 108 from the side;

FIG. 10 is a sectional view taken along line 10—10 of FIG. 8 showing a detail of vacuum head 108 from above;

DETAILED DESCRIPTION OF THE APPARATUS AND ITS OPERATION

FEED MAGAZINE (FIGS. 1, 2, 4 and 7)

Figure 1:
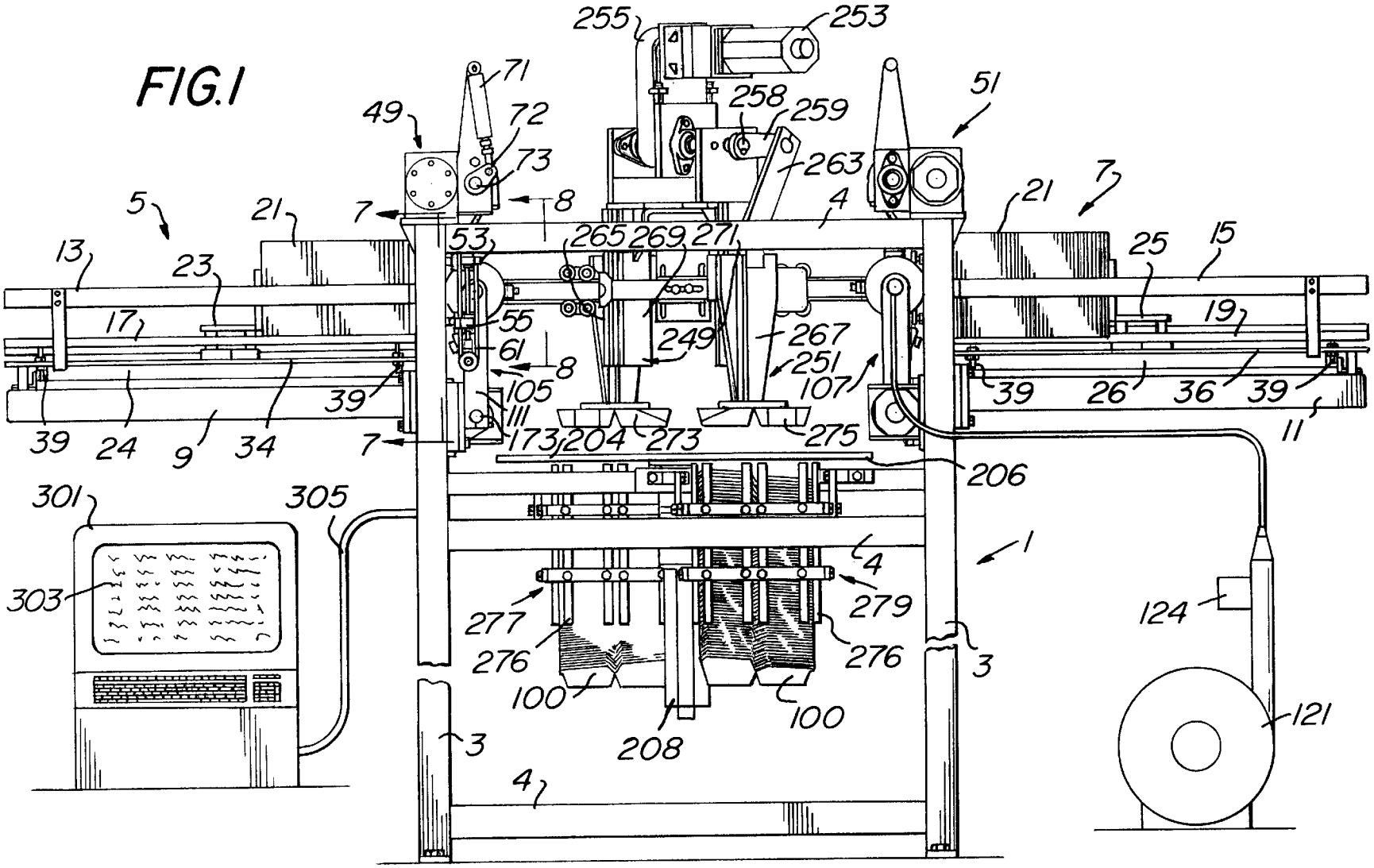
FIG. 1 shows a side elevational view of a preferred embodiment of a carton forming apparatus according to the invention.
Figure 2:
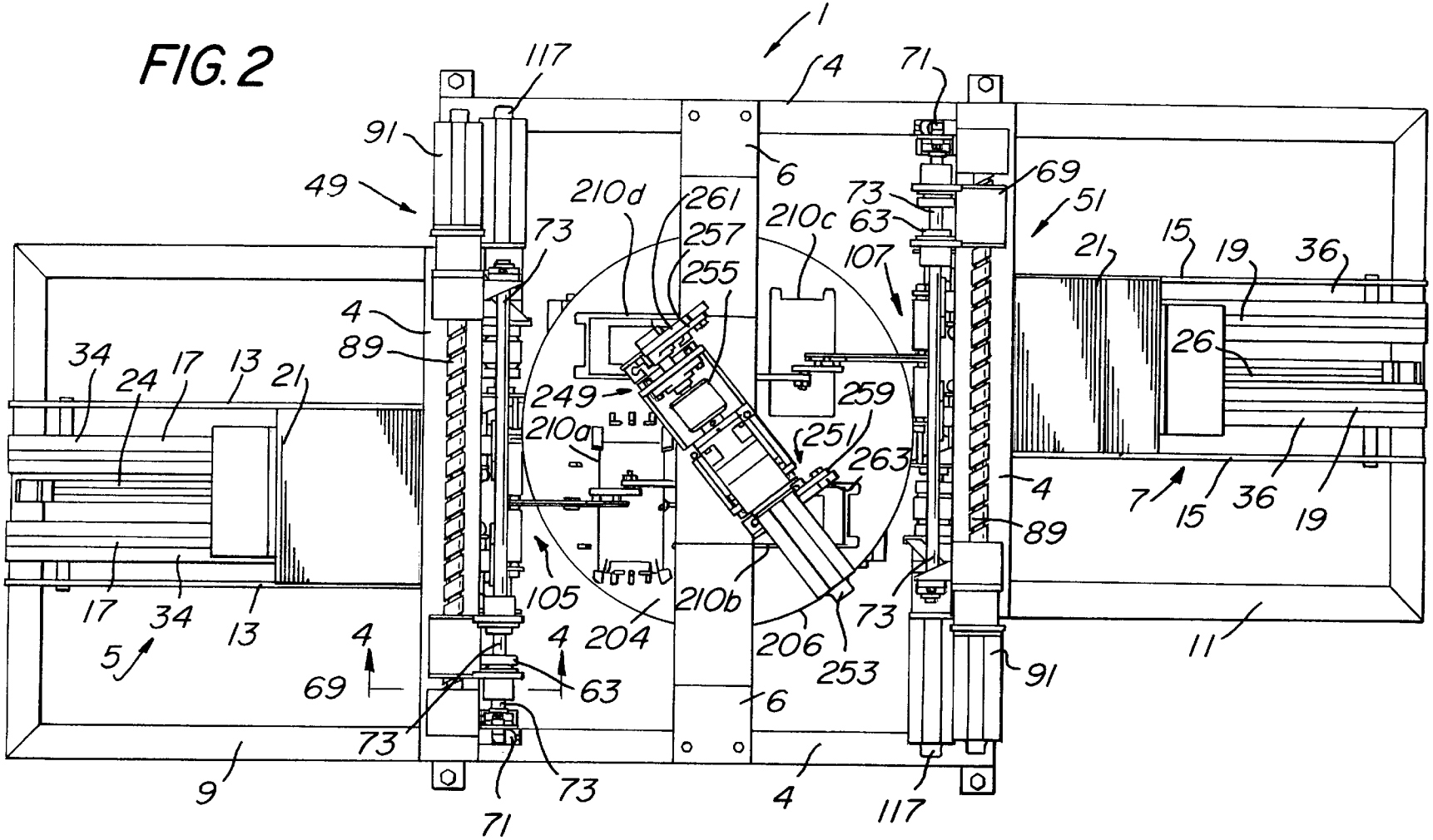
FIG. 2 shows a plan view of the carton forming apparatus of FIG. 1.

With reference first to FIGS. 1 and 2, FIG. 1 shows a side elevational view of a preferred embodiment of the apparatus built around support frame 1. Support frame 1 is typically constructed from tubular steel beam uprights 3 and cross pieces 4 which can be welded or bolted together to provide a relatively rigid frame for support of the apparatus components. Twin feed magazines, shown at 5 and 7, are mounted on opposite sides of the apparatus and supported by respective magazine support frames 9 and 11 cantilevered from uprights 3 of frame 1, shown to best advantage in the plan view of FIG. 2. Magazine support frames 9 and 11 support respective side guide elements 13 and 15 and carton blank support rails 17 and 19.

Figure 3:
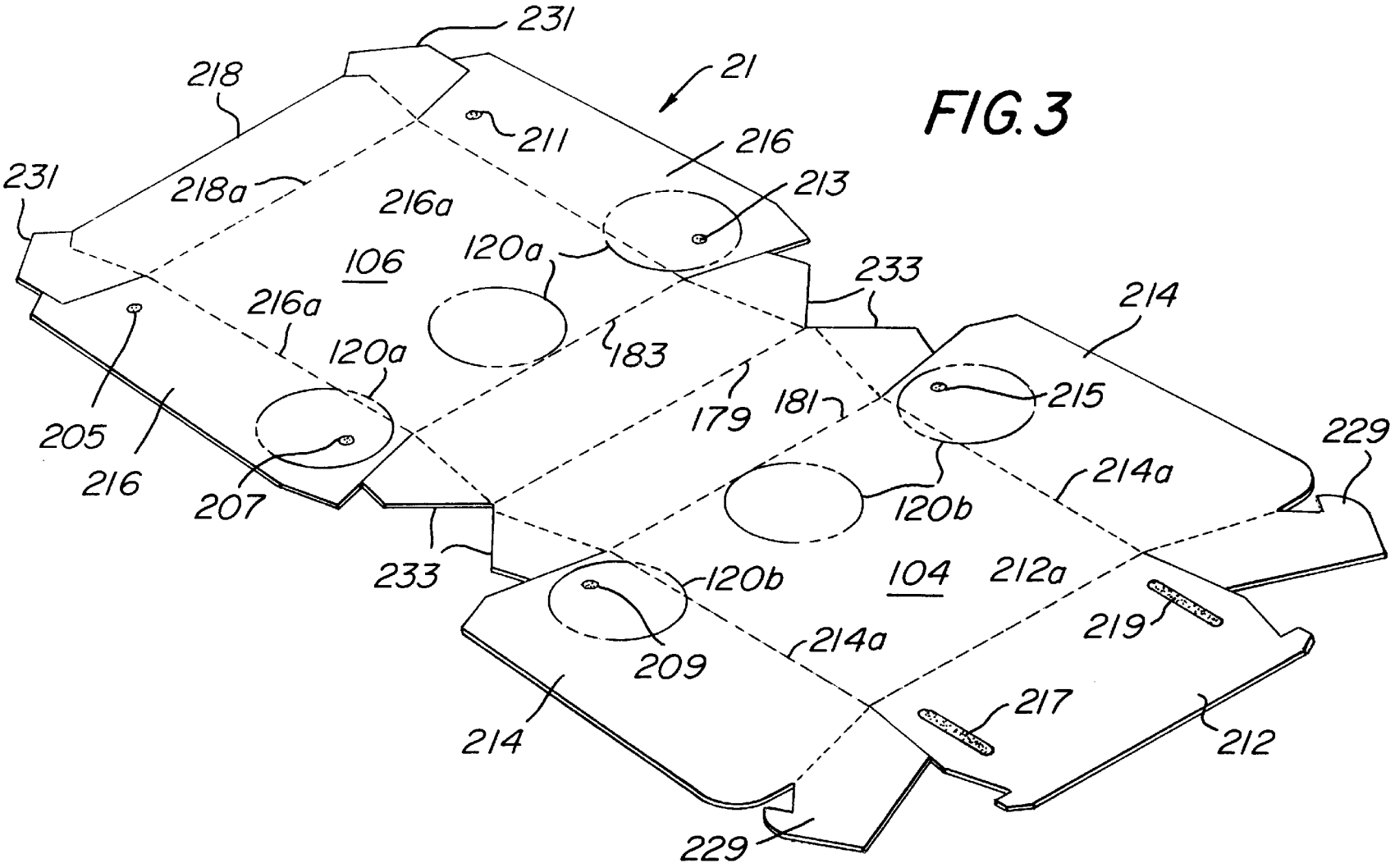
FIG. 3 shows an isometric view of a carton blank for a clamshell type carton.

Carton blanks 21, one of which is shown in FIG. 3, are stacked vertically between the side guide elements 13 and rest on edge on the support rails 17 in feed magazine 5 and are similarly stacked between side guide elements 15 and rest on edge on support rails 19 of feed magazine 11. The side guide elements 13 and 15 as well as support rails 17 and 19 are mounted to their respective support frames 9 and 11 by respective guide rail support beams 34 and 36. Pusher elements 23 and 25, biased by respective air cylinders 24 and 26 (shown in FIGS. 1 and 2), ride on the guide rail support beams 34 and 36 respectively and force each stack of carton blanks along respective paths defined by the support rails 17 and 19 and guide elements 13 and 15.

Each stack of carton blanks 21 is forced up against a respective carton blank by the action of biasing air cylinders 24 and 26 operating on respective pusher elements 23 and 25. An example of a carton blank frame is shown at 27 in FIG. 7. Carton blank frame 27 is shown associated with feed magazine 5 and is comprised of elongated vertical members 29 and elongated horizontal members 31. The carton blank frames are arranged on opposite sides of the apparatus mounted to the uppermost crosspieces 4 of frame 1 and positioned to engage the foremost carton blank in each stack supported between side guide elements 13 or 15 and on support rails 17 or 19. Note in FIG. 7 that guide elements 13 are laterally adjustable perpendicularly to the path of the carton blanks by means of brackets 33. Brackets 33 are "L" shaped, one leg being fixed to one of the guide elements 13 and the other leg bolted to one of the vertical members 29 through threaded mounting holes 37 in member 29 and slots 35 in bracket 33. Slots 35 allow guide elements 13 to be adjusted laterally relatively to vertical frame members 29 to compensate for different carton blank sizes or configurations, as well as to provide a fine tuning adjustment of the lateral position of the carton blanks within the feed magazine. The same adjustment means is provided for guide elements 15 on the opposite feed magazine 7.

Figure 4:
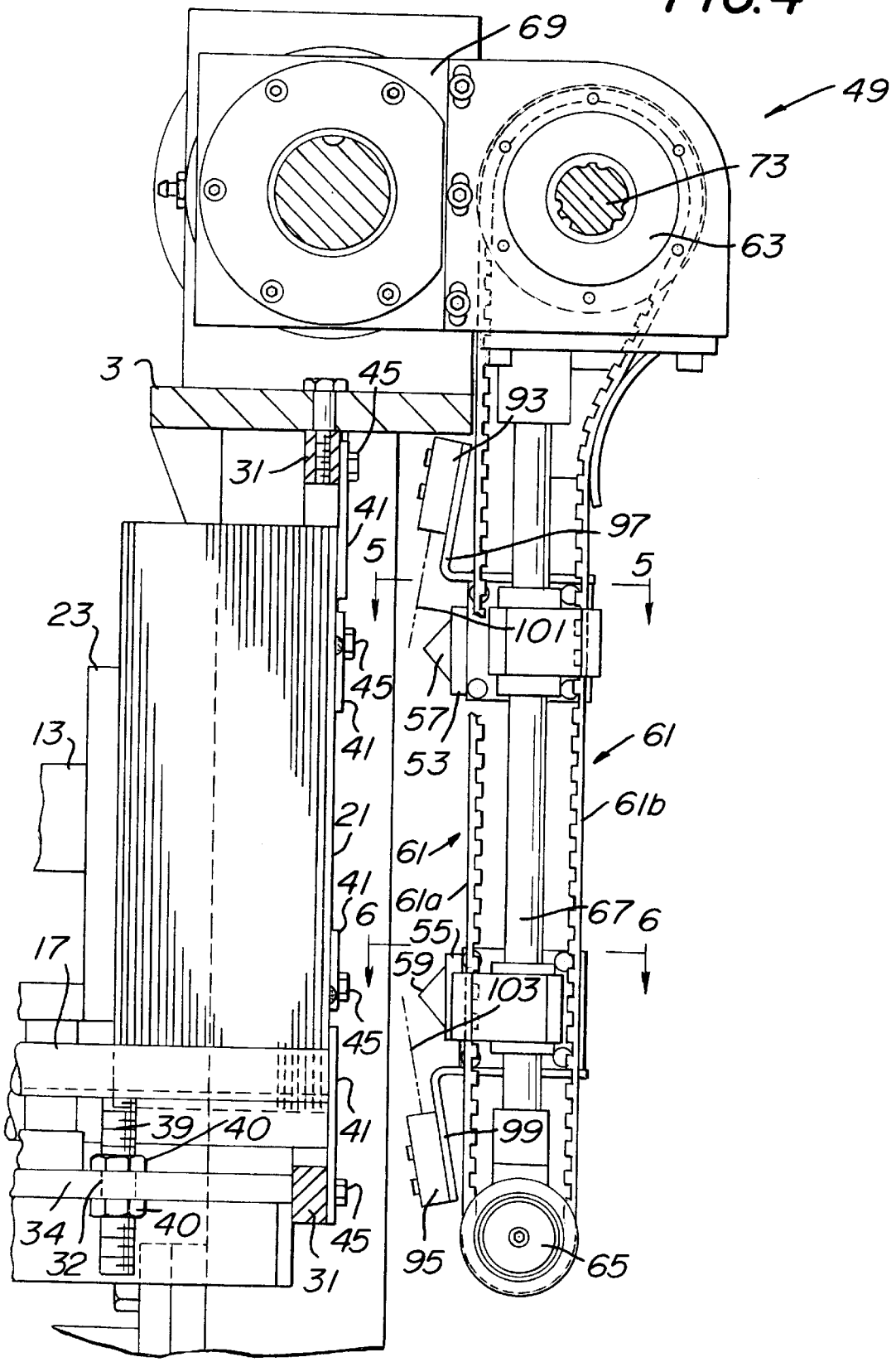
FIG. 4 shows a detailed side view of an adhesive application means taken along lines 4—4 from FIG. 2, at a larger scale with respect to FIG. 2.
Figure 7:
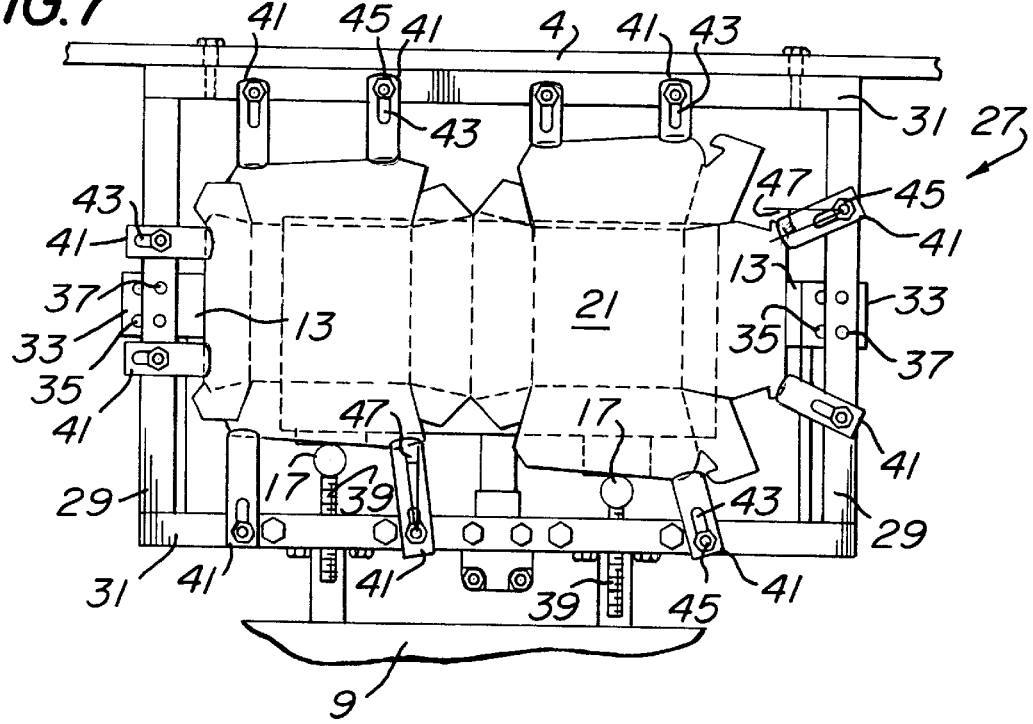
FIG. 7 shows an end view of feed magazine 5 taken along line 7—7 of FIG. 1 on a larger scale with respect to FIG. 1.

Support rails 17 are vertically adjustable, by means of jackscrews 39, seen in FIGS. 4 and 7. The jackscrews 39 pass through holes 32 in guide rail support beams 34, which mount the guide rails 17 to magazine support frame 9. Similar support beams 36 mount support rails 19 to magazine support frame 11. Jackscrews 39 advance or retreat relatively to frame member 31 when jam nuts 40 are rotated, thus providing an adjustment feature to the support rails. Jackscrews 39 are welded to support rails 17. Rotating jackscrews 39 thus raises or lowers support rails 17 relatively to support beams 34, allowing vertical adjustment to compensate for different box configurations or to adjust the vertical position of the stack of box blanks in the magazine 5. A similar vertical adjustment is provided for support rails 19 on the opposite feed magazine 7.

Carton blank frame 27 is further comprised of a plurality of fingers 41 in FIG. 7. Fingers 41 are preferably comprised of a material such as steel, being relatively stiff. Fingers 41 are mounted on carton blank frame 27 at predetermined locations to engage the foremost carton blank 21 at points about its periphery and retain the stack of carton blanks against the pushing action of pusher elements 23 or 25. Fingers 41 are translationally adjustable relatively to the horizontal frame member 31 or vertical frame member 29 to which they are attached by means of slots 43 engaging mounting screws 45. Screws 45 allow translational adjustment of fingers 41 along slots 43 when the screw is loosened, but retain the fingers fixedly against the frame member in the desired position when screw 45 is tightened. Fingers 41 are further rotationally adjustable as shown at 47 in FIG. 7 by rotating the fingers relatively to the frame element when screw 45 is loosened and tightening the screw to fix the finger at a desired predetermined angle 47. The translational and rotational adjustability of fingers 41 allows the fingers to be positioned to accommodate a wide variety of carton blank sizes and shapes, as well as allowing relatively fine control over the engagement of each finger with the foremost carton blank, the translational adjustment allowing relatively greater or lesser overlap of the blank by the fingers thereby controlling the retention of the blank within the frame and the rotational adjustment allowing a greater choice of contact points between the fingers and the carton blank.

Carton blank frames 27 present the foremost carton blanks in each respective stack 5 and 7 to the adhesive application means 49 and 51. Adhesive application means 49 and 51 are arranged on opposite sides of the apparatus adjacent to each feed magazine 5 and 7. FIG. 4 shows a detailed side view of adhesive application means 49, means 51 being identical.

ADHESIVE APPLICATION MEANS

(FIGS. 4–6)

Figure 5:
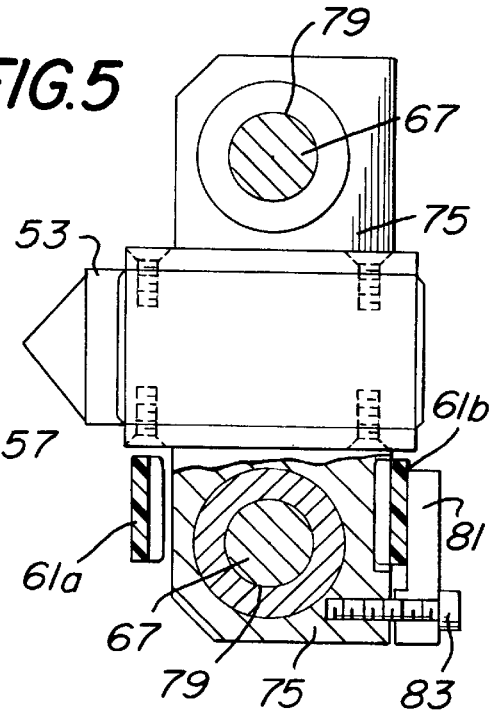
FIG. 5 shows a sectional view taken along line 5—5 of FIG. 4 on a larger scale than FIG. 4 showing details of glue gun mounting.
Figure 6:
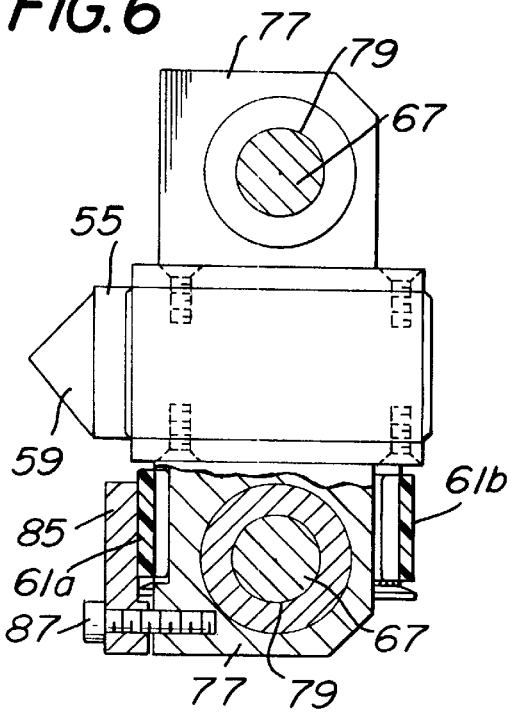
FIG. 6 shows a sectional view taken along line 6—6 of FIG. 4 on a larger scale than FIG. 4 showing details of glue gun mounting.

Adhesive application means 49 is comprised of upper and lower glue guns 53 and 55 comprising applicators having respective nozzles 57 and 59 for directing a stream of glue onto adhesive receiving regions on carton blank 21 denoted by numbers 205, 207, 209, 211, 213, 215, 217 and 219 in FIG. 3. Glue guns 53 and 55 move vertically on guide bars 67 which are arranged on either side of the glue guns and are suspended from traversing carriage 69. The glue guns 53 and 55 engage guide bars 67 via side housings 75 and 77 respectively having cylindrical apertures 79 in which the guide bars 67 slidably interfit, as shown in FIGS. 4, 5 and 6.

Glue guns 53 and 55 are each fixed to a vertically arranged pulley belt 61 which loops around driven pulley 63 on spline shaft 73 and idler pulley 65, rotationally mounted at the lower end of guide bars 67. Air cylinder 71 and crank 72 (FIG. 2) power pulley 63 through spline shaft 73.

By turning pulley 63, air cylinder 71 moves pulley belt 61, thereby adjusting the vertical position of glue guns 53 and 55 attached thereto relatively to carton blank 21. As shown in FIG. 5, glue gun 53 is attached to the back run of pulley belt 61, marked 61*b* in the figure. Attachment of glue gun 53 to belt run 61*b* is accomplished by means of clamping plate 81 fixed to housing 75 by bolt 83 providing a clamping action between belt run 61*b* and housing 75. The use of a clamping plate allows the glue gun to be readily adjusted vertically on belt run 61*b* to provide adaptability for different carton blank sizes and shapes. In contrast, as seen in FIG. 6, glue gun 55 is attached to the front run of pulley belt 61, marked 61*a* in the figure. Attachment of glue gun 55 to belt run 61*a* is by means of a clamping plate 85 and bolt 87 similar to the attachment of glue gun 53 to belt run 61*b*, providing the same adjustability of glue gun position on the belt. With guns 53 and 55 attached to different runs on the same pulley belt, rotation of driven pulley 63 will move both guns vertically in opposite directions from each other along guide bars 67. For example, when viewing FIG. 4, a clockwise rotation of pulley 63 by air cylinder 71 will move glue gun 53 downwardly and glue gun 55 upwardly, thus moving the guns vertically closer together. A counterclockwise rotation of pulley 63 will move glue gun 53 upwardly and glue gun 55 downwardly, moving the glue guns vertically farther apart. Driven pulley 63, seen in FIG. 4, is naturally limited in its rotation by the stroke of actuating air cylinder 71 working through crank 72 to rotate spline shaft 73, as shown in FIG. 1, and the stroke of air cylinder 71 is calculated such that glue guns 53 and 55 will neither contact one another nor overrun driven pulley 63 nor idler pulley 65 when the glue guns are positioned vertically. An air cylinder and crank combination is effective in positioning the glue guns for a relatively simple two position glue pattern, as required in this application, but for a more complex glue pattern, a servo motor could be substituted for the air cylinder and crank to rotate spline shaft 73 and vertically position the glue guns.

As best shown in FIG. 2, lateral positioning of the glue guns relatively to the carton blank is effected by the traversing carriage 69 traveling laterally along ball screw 89, thereby allowing the glue guns to laterally traverse the carton blank presented by the carton blank frame 27. Motor 91 drives screw shaft 89 which engages a ball screw fixed in traversing carriage 69. Rotation of screw shaft 89 against the rotationally fixed ball screw causes housing 69 and the attached vertical guide bars 67, pulleys 63 and 65 and glue guns 53 and 55 to move laterally by screw action. Pulley 63 is slidably mounted on spline shaft 73 and is guided along spline shaft 73 during traversing carriage lateral motion, contact between pulley 63 and spline shaft 73 maintaining the vertical orientation of vertical guide bars 67 against the rotation of the screw shaft 89.

Associated with each glue gun 53 and 55 is a respective optical sensor 93 and 95, shown in FIG. 4. The optical sensors are mounted to glue guns 53 and 55 by mounting brackets 97 and 99 respectively and have respective lines of sight to the nozzles 57 and 59. The sensors each project a respective beam of light 101 and 103 which will intercept a glue stream directed by a respective nozzle onto a carton blank. When a light beam hits a glue stream, light is reflected from the stream back to the sensor where the reflected light is sensed and a signal is generated indicating that the glue stream was detected by the sensor. The optical sensors are aligned so that the light beams intercept the intended path of the glue stream at a predetermined distance from the nozzle, giving an indication of both the presence or absence of a glue stream and the presence or absence of a glue stream at a predetermined point in space. Thus, the sensors can detect not only whether the glue guns are working by directing a stream of adhesive to the carton blank when commanded, but that the glue guns are accurately aimed at a predetermined adhesive receiving location on the carton blank. Thus, a lack of a signal from the optical sensor after the glue guns have been commanded to fire can indicate either a malfunction of a glue gun due, for example, to nozzle clogging or exhaustion of the glue reservoir, or a misaligned glue gun directing its glue stream to the wrong location on the carton blank.

Once adhesive has been applied to carton blanks 21 in feed magazines 5 and 7 respective transfer means 105 and 107 remove the carton blanks from carton blank frames 27 in each magazine. As shown in FIGS. 1 and 2, the transfer means are arranged on opposite sides of the apparatus adjacent to the feed magazines 5 and 7. Both transfer means are the same, therefore only transfer means 105, shown in FIGS. 8–13, will be described in detail.

TRANSFER MEANS

(FIGS. 8–13)

Transfer means 105 is comprised of vacuum heads 108 and 109, sliding housings 137*a* and 137*b*, swing arms 111, slider bar 113, rotating guide 115 and motor 117, shown in FIG. 2. Vacuum heads 108 and 109 are located on sliding housings 137*a* and 137*b* respectively at the ends of swing arms 111 and have suction cups 119, which engage carton blank 21. The suction cups of vacuum head 108 engage carton blank 21 at the locations marked 120*a* and the suction cups of vacuum head 109 at locations marked 120*b* shown in FIG. 3. A vacuum is drawn by vacuum or negative pressure means 121, which could be an induction fan or an air pump, thereby retaining blank 21 to suction cups 119 when it is desired to effect the transfer of carton blank 21 from frame 27. Also associated with vacuum means 121 is a means 124 for selectively interrupting the vacuum means. Selective interrupting means 124, seen in FIG. 1, could be, for example, a valve interposed between vacuum means 121 and suction cups 119 which, when closed, prevents a vacuum from being drawn within the cups. Cups 119 have an air bleeding means 126 which allows air to flow back into the cups when the vacuum means is interrupted, thereby releasing the carton blank from transfer means 105. Bleeding means 126, shown in FIG. 10, could, for example, comprise a valve means connectable to a pressurized air supply for blowing air back into cups 119 when it is desirable to release a carton blank from the transfer means. As seen in FIGS. 9 and 10, suction cups 119 are fixed to mounting bracket 123 which is attached to trunnion 125. Trunnion 125 is journaled and rotationally adjustable within trunnion housing 133 by means of trunnion beam 135, biasing spring 127, threaded stud 131 engaging threaded hole 132 and jam nut 129, all on sliding housing 137*a*. As seen in FIG. 9, biasing spring 127 pushes on trunnion beam 135, tending to rotate trunnion beam 135 clockwise, forcing threaded stud 131 against the bumper pad 130 on the front face of sliding housing 137*a*. Rotating threaded stud 131 causes the stud threads to engage the mating threads in hole 132, thereby causing stud 131 to advance or retreat through trunnion beam 135 depending upon the direction of stud rotation. An advancing stud 131 pushes on bumper pad 130 and rotates beam 135 counterclockwise, compressing biasing spring 127; a retreating stud 131 causes beam 135 to rotate clockwise under the force of biasing spring 127. Thus, stud 131 allows the angle of trunnion beam 135 to be adjusted relatively to sliding housing 137*a*. Adjustment of the trunnion beam angle determines the angle at which the vacuum head 108 engages the carton blank 21 and ensures that all vacuum heads 119 are aligned perpendicularly to and fully engage the carton blank. Once the proper trunnion beam angle is set, jam nut 129 is rotated on stud 131 to a position against trunnion beam 135. In this position jam nut 129 prevents stud 131 from undesired rotation, for example, due to machine vibration during operation, and thus prevents inadvertent changing of the set angle of trunnion beam 135. The same configuration is duplicated for vacuum housing 109 on sliding housing 137*b* and similarly provides for alignment adjustment thereof. The vacuum heads 108 and 109 can also be laterally adjusted relatively to the carton blank by sliding trunnion 125 within lug 136 and trunnion housing 133. This adjustment permits further adaptability for different size or shape blanks, as well as allowing variability in the location of suction cup contact with the carton blank.

Trunnion housing 133 is mounted on sliding housing 137*a* via bolts 139. Sliding housing 137*a* has upper and lower v-notched rollers 141 rotatably mounted on studs 143 which engage mating tracks 145 on vacuum head support beam 147. A similar arrangement is also provided for sliding housing 137*b*.

Support beam 147 is rotationally mounted between swing arms 111 on rotational bearings 149 connected by beam-bearing couplings 150 seen in FIG. 10. Rotational bearings 149 permit vacuum heads 108 and 109 to rotate relatively to swing arms 111 which allows the vacuum heads to engage the carton blanks 21 when vertically stacked in the feed magazines 5 and 7, as seen in FIG. 11, and when horizontally oriented, as seen in FIG. 13.

Figure 8:
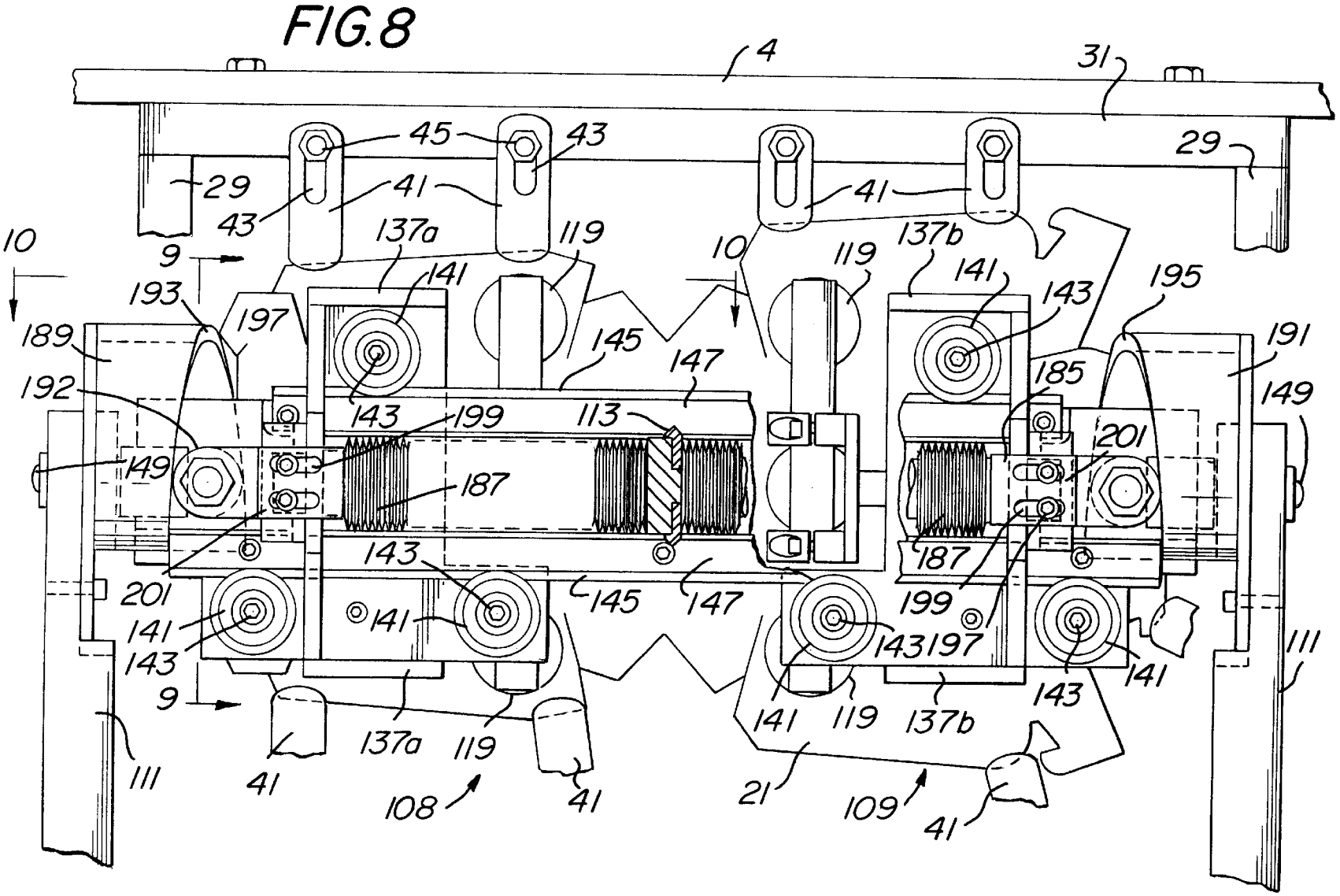
FIG. 8 shows a partial view of the transfer means 105 engaging a carton blank in feed magazine 5, taken along lines 8—8 of FIG. 1.

Rotation of the vacuum heads is effected by slider bar 113 and rotating guide 115. As shown in FIGS. 8–10, one end of slider bar 113 bolts directly into vacuum head support beam 147 by means of bolts 151 engaging threaded holes 153. Adjustment between slider bar 113 and beam 147 can be made by shimming the bolted joint, if necessary. The other end of slider bar 113 slidably engages guide wheels 155 on rotating guide 115. Rotating guide 115 can pivot about stub axle 157 which is fixed in horizontal bracket 159. Horizontal bracket 159 adjustably attaches to flanged mounting bracket 161 by means of channel bracket 163. Flanged mounting bracket 161 is fixed to tubular frame member 6, shown in detail in FIG. 11 and also depicted on a smaller scale in FIG. 2. Horizontal bracket 159 is vertically adjustable on mounting bracket 161 by means of bolts (not shown) in channel bracket 163 which ride in slots 165 in mounting bracket 161. Tightening the bolts fixes the vertical position of the channel bracket 163 on mounting bracket 161, thereby fixing the vertical position of horizontal bracket 159. The horizontal position of horizontal bracket 159 can be adjusted by means of slot 167 and bolts 169 and nuts 171. Horizontal bracket 159 can be slid horizontally on bolts 169 along the length of slot 167 to a desired predetermined position and then fixed in place by tightening nuts 171.

The vertical and horizontal adjustment features of the horizontal bracket 159 in conjunction with the slider bar linkage 113 allows for the fine angular adjustment of the vacuum heads 108 and 109 specifically with regard to contact angle with the carton blank. The transfer means thus provides two independent angular adjustment features of the vacuum heads, the first effected by the angular adjustment of trunnion beam 135 mentioned earlier and the second effected by the vertical and horizontal adjustment of horizontal bracket 159. Two independent angular adjustment means allow the vacuum head contact angle with the carton blank to be adjusted independently in both the vertical position, seen in FIG. 11, when a blank held in feed magazine 5 is engaged, or in the horizontal position, as seen in FIG. 13. This adjustment capability ensures good alignment of the vacuum heads in the vertical and horizontal positions of interest, allowing positive engagement of a carton blank and precise positioning of the blank on transfer from the feed magazine. The adjustment features also allow an operator to compensate for various misalignments and tolerances in machine construction and operation.

Figure 11:
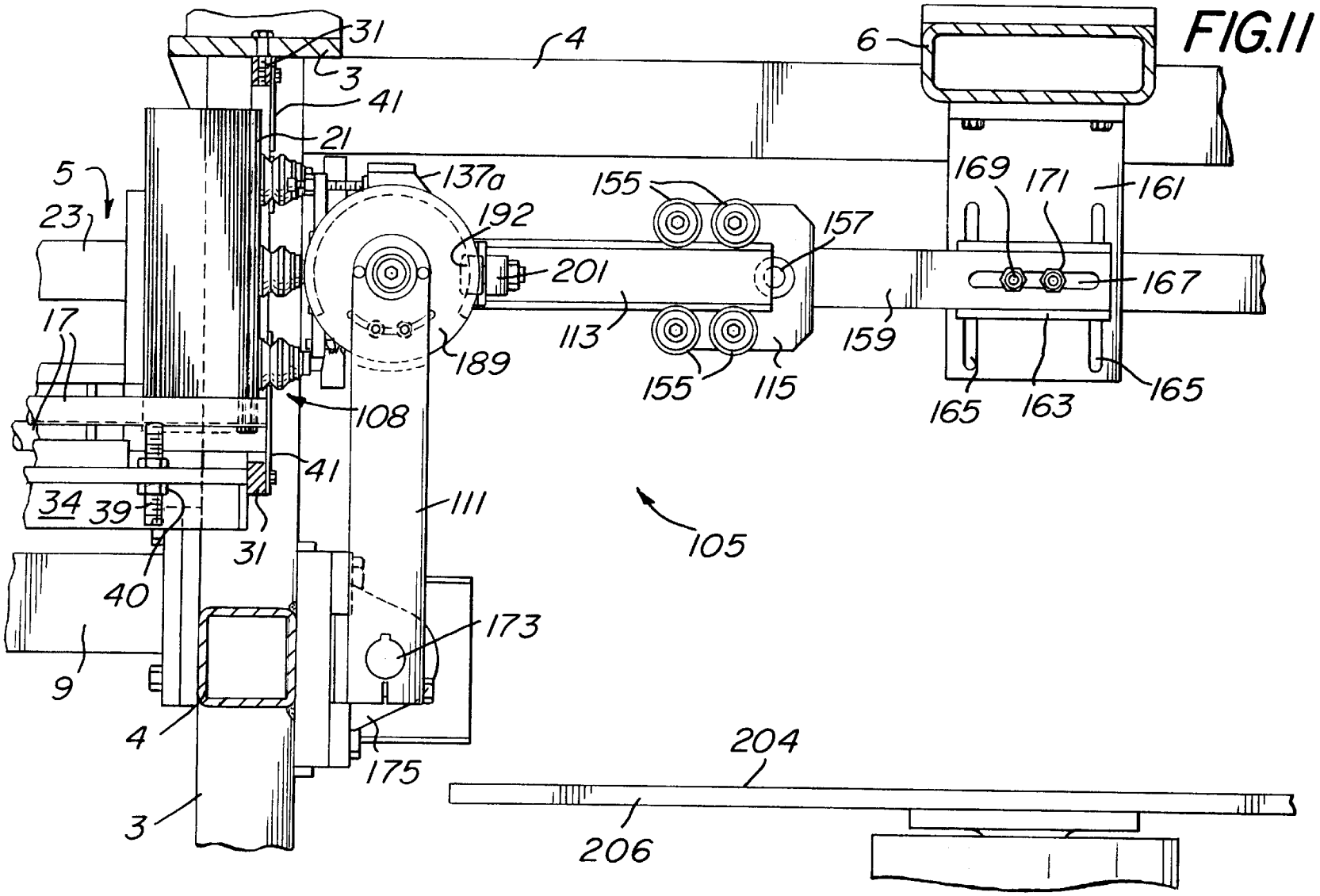
FIG. 11 shows a side view of transfer means 105 in the vertical position.
Figure 12:
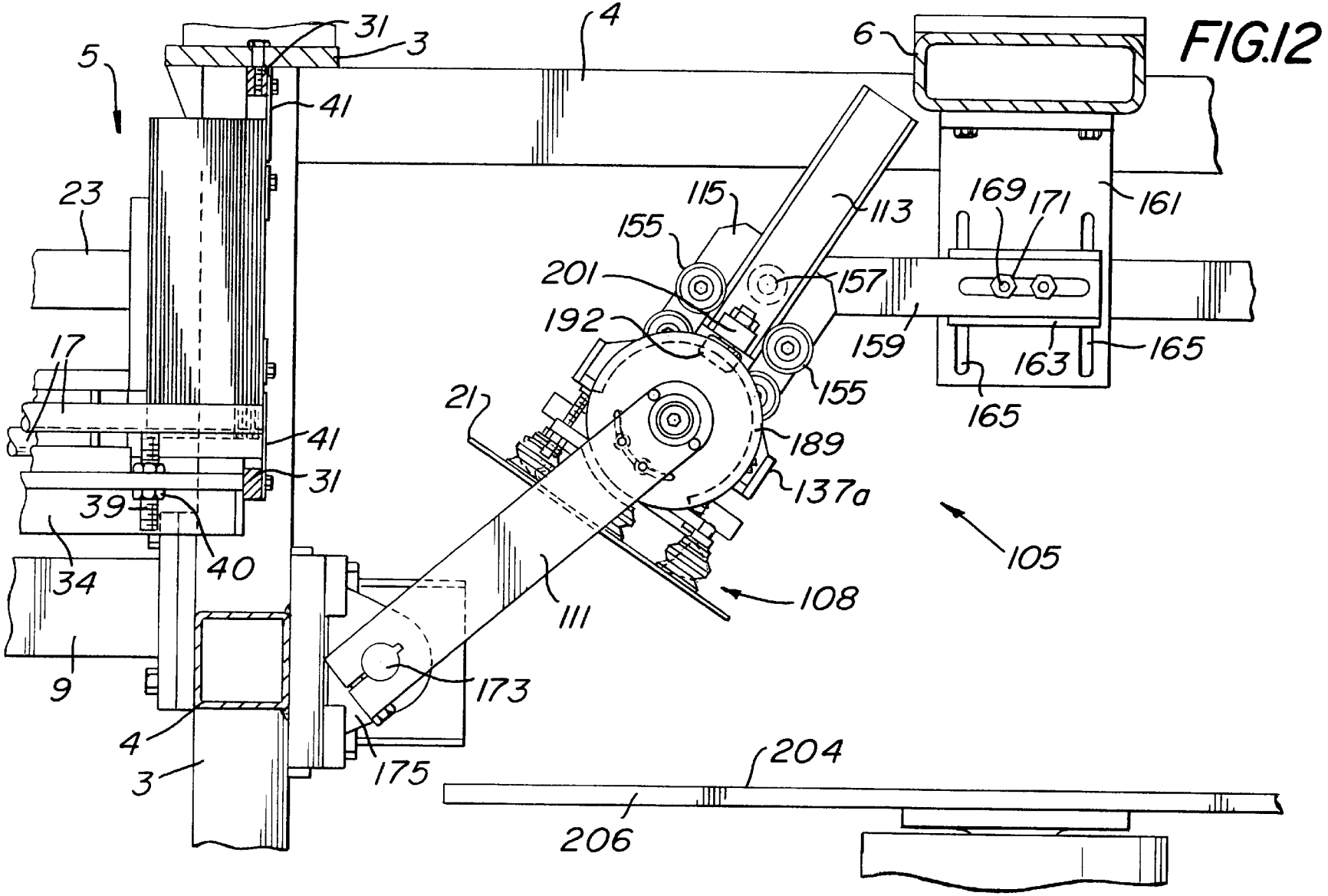
FIG. 12 shows a side view of transfer means 105 after passing through an angular orientation of 45°.
Figure 13:
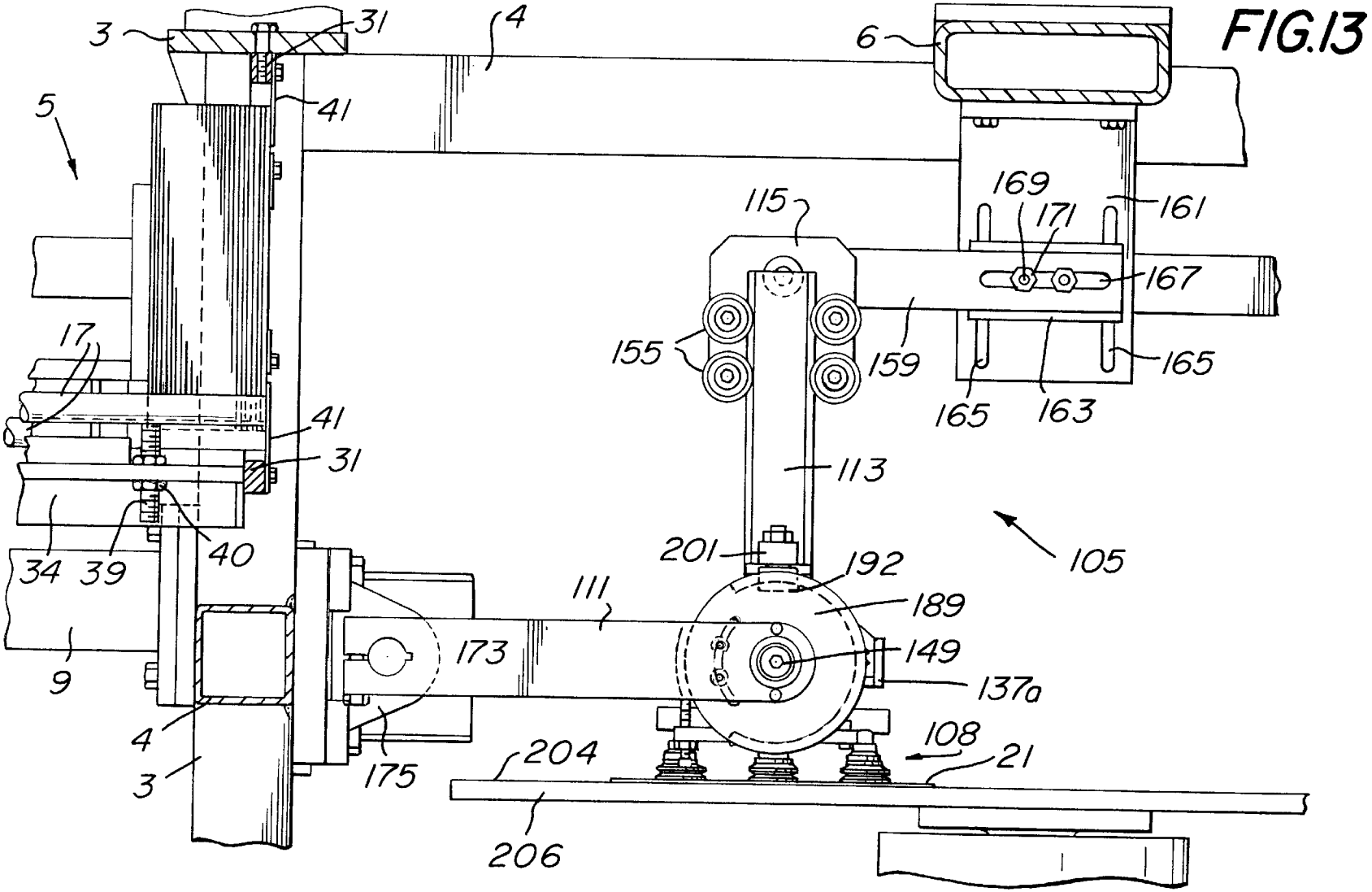
FIG. 13 shows a side view of transfer means 105 in the horizontal position.

FIGS. 11–13 depict the operation of the transfer means 105. The sequence begins with FIG. 11 showing the swing arms 111 vertically oriented and vacuum heads 108 and 109 engaging carton blank 21 held in frame 27 in feed magazine 5. Swing arms 111 rotate on keyed shaft 173 driven by motor 117 (see FIG. 2) and mounted on uprights 3 via shaft bearings 175. Vacuum means 121 is commanded to draw a vacuum for vacuum heads 108 and 109 which engage carton blank 21 by means of the suction. Motor 117 is commanded to apply torque to keyed shaft 173, turning the shaft clockwise. Swing arms 111 rotate clockwise pulling carton blank 21 held on vacuum heads 108 and 109 from magazine 5 through the fingers 41 of frame 27. Slider bar 113 slides to the right on rollers 155 and causes rotating guide 115 to rotate counterclockwise on stub axle 157, further causing sliding housings 137*a* and 137*b* to rotate counterclockwise on rotational bearings 149, as seen in FIG. 12. As swing arms 111 pass through 45° slider bar 113 begins to slide downwardly away from rotating guide 115. Motor 117 continues to turn keyed shaft 173 clockwise until swing arms 111 are substantially horizontal and slider bar 113 is substantially vertical, as seen in FIG. 13. Note that sliding housings 137*a* and 137*b* and rotating guide 115 have rotated counterclockwise from a horizontal position shown in FIG. 11, to a vertical position seen in FIG. 13 due to the interaction of the slider bar 113 and rotating guide 115.

Figure 15:
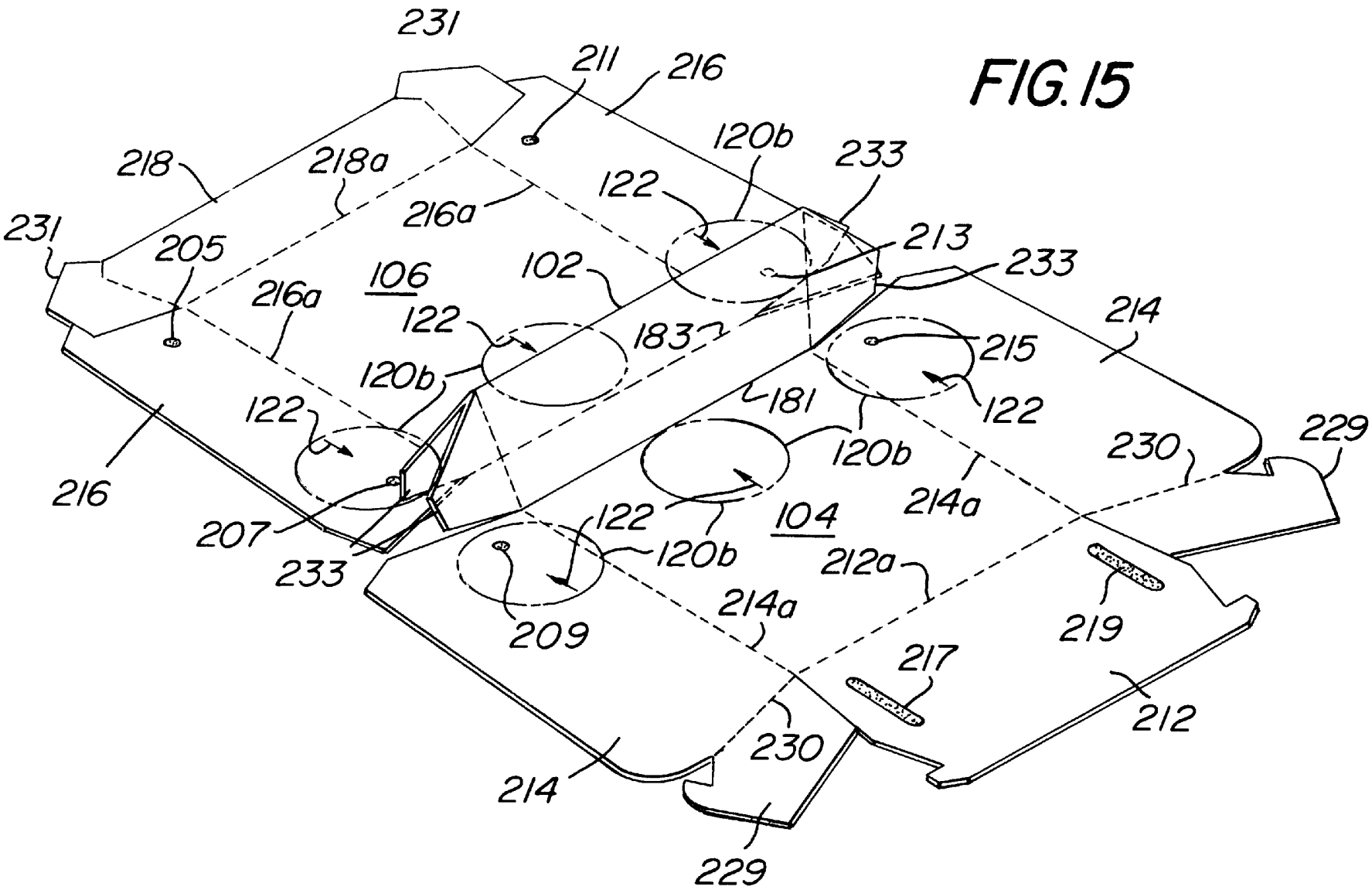
FIG. 15 shows an isometric view of carton blank 21 compressed to form clamshell hinge 102.
Figure 17:
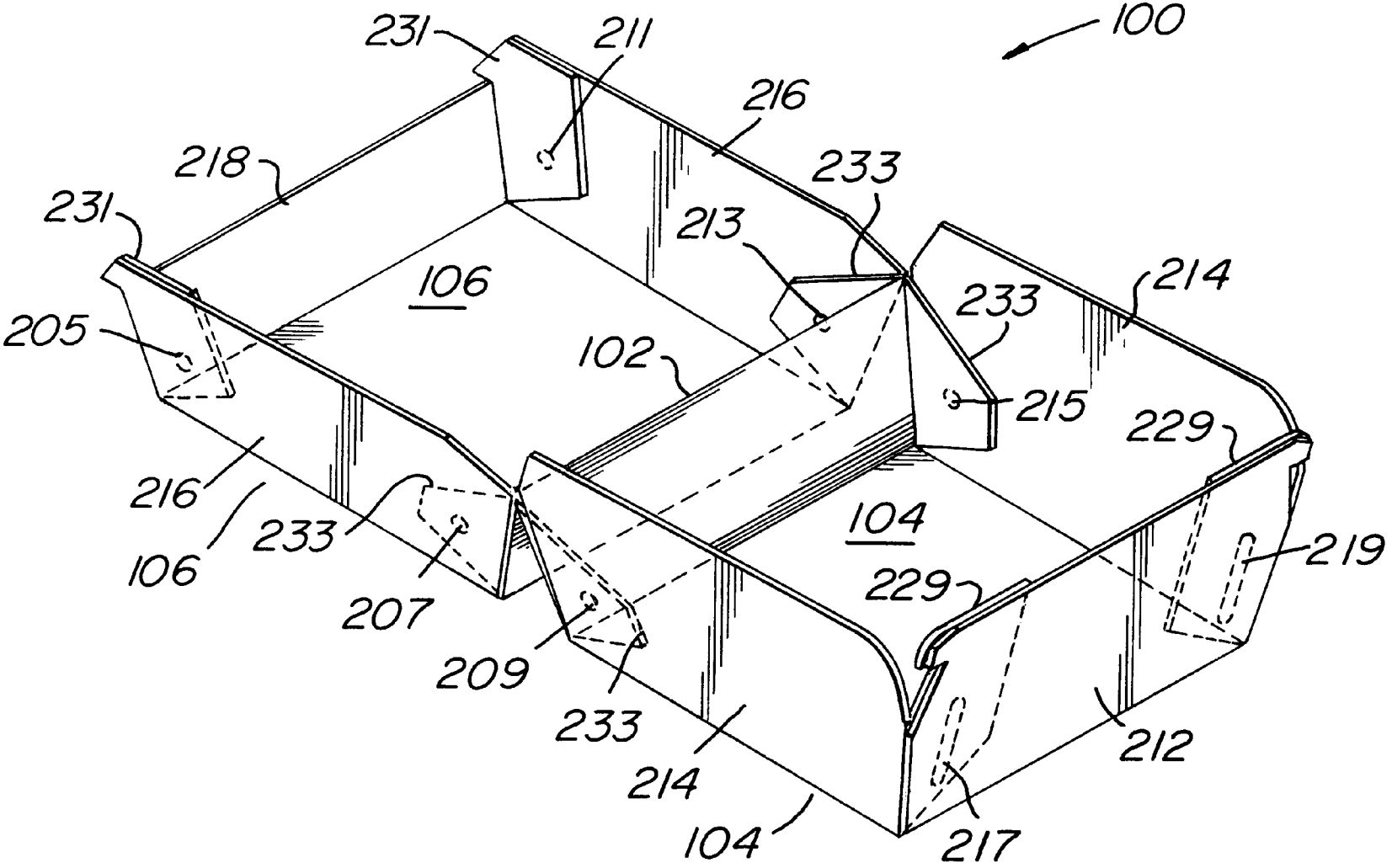
FIG. 17 shows an isometric of a formed carton 100.
Figure 18:
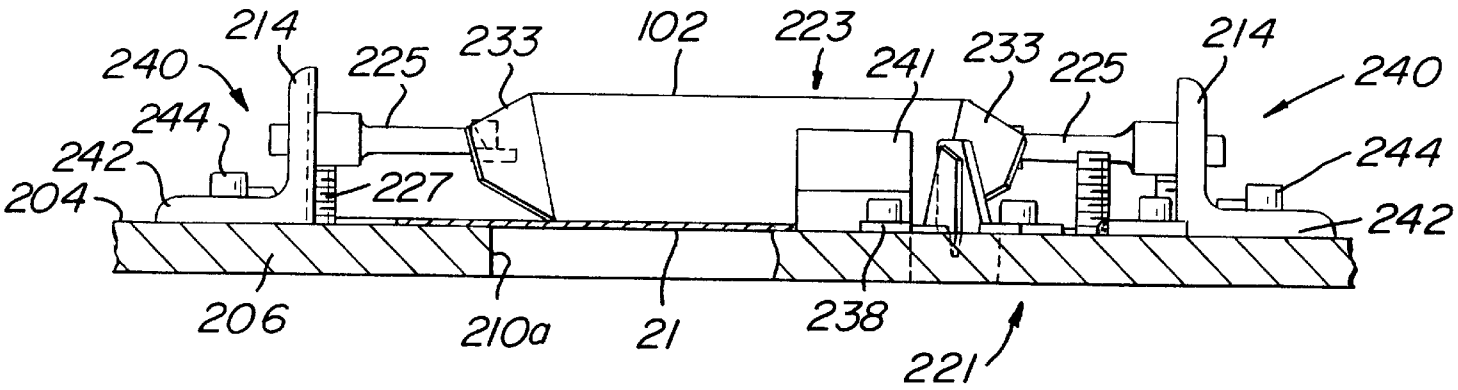
FIG. 18 shows an end view of carton blank 21 overlying aperture 210*a;*

In the formation of certain types of cartons, most notably "clamshell" cartons as depicted at 100 in FIG. 17, it is preferable that the clamshell hinge 102 be formed during the transfer step. Clamshell cartons have a bottom half 104 and a top half 106 hinged together along a common edge forming a carton in the manner of a clamshell. FIG. 3 shows a clamshell carton blank 21 with predetermined lines 179, 181 and 183 designating the fold lines of the hinge 102. The hinge is formed by forcing the top half 106 of the blank 21 toward the bottom half 104, compressing the region of the carton blank between predetermined lines 181 and 183. The lines being prescored, the region buckles outwardly, as shown in FIG. 15, and folds along the predetermined fold lines when under compression, fold line 179 forming the hinge 102 about which the top of the carton will rotate once it is formed.

In the preferred embodiment according to the invention, the clamshell hinge is formed by the transfer means 105 and 107 as the vacuum heads rotate from the vertical to the horizontal position as seen in FIGS. 11–13. Sliding housings 137*a* and 137*b*, shown in FIGS. 8–10 are capable of lateral motion along guide shaft 185 and vacuum head support beam 147 on v-notched rollers 141. Suitable biasing means such as Belleville washer stack 187 on guide shaft 185 normally biases the housings 137*a* and 137*b* away from each other, but the housings are forced together upon rotation of the vacuum head support beam 147 by the action of barrel cams 189 and 191 arranged at either end of support beam 147. Barrel cams 189 and 190 are fixed to swing arms 111 adjacent to housings 137*a* and 137*b* respectively. Cam follower 192, shown in FIG. 10 for housing 137*a* engages cam 189 along the helical cam surface 193. A similar arrangement is provided for sliding housing 137*b* and cam 191 and its associated cam surface 195, not shown in detail.

When vacuum head support beam 147 rotates relatively to swing arms 111 barrel cams 189 and 191 remain fixed relatively to swing arms 111, thus cam follower 192 of sliding housing 137*a* and its counterpart on sliding housing 137*b* rotate with support beam 147 and ride against helical cam surfaces 193 and 195 respectively and the resultant camming action forces the sliding housings toward each other, compressing the Belleville washer stack 187. The barrel cams 189 and 191 are positioned on the swing arms so that the sliding housings 137*a* and 137*b* are at their maximum distance apart when swing arms 111 are vertical and at a minimum distance when swing arms 111 are horizontal. Preferably, a carton blank 21 held in frame 27 is engaged by vacuum heads 108 and 109 at respective locations marked 120*a* and 120*b* in FIG. 3 when sliding housings 137*a* and 137*b* are at maximum separation. As swing arms 111 rotate clockwise carton blank 21 is stripped from magazine 5 through fingers 41 of frame 27, and sliding housings 137*a* and 137*b* move toward each other under the camming action of cam followers riding against the helical cam surfaces 193 and 195 of barrel cams 189 and 191, respectively. Carton blank 21 is held fast to suction cups 119 and thereby compressed in the direction shown by the arrows 122 in FIG. 15 between the sliding housings 137*a* and 137*b*. This compression forces the carton to buckle and fold along predetermined lines 179, 181 and 183 as illustrated in FIG. 15, thus forming the clamshell hinge completely when swing arms 111 are in the horizontal position, sliding housings 137*a* and 137*b* are at a minimum distance apart, and carton blank 21 is horizontal, as seen in FIG. 13. After the carton blank is released and swing arms 111 rotate back to the vertical position and cup-shaped or Belleville washer stack 187 effects a separation of sliding housings 137*a* and 137*b*, forcing cam followers 192 to contact their respective cam tracks as vacuum head support beam 147 rotates opposite to swing arm rotation.

Adjustment of cam follower 192 is provided by bolts 197 engaging slots 199 in the cam follower mounting brackets 201. Mounting bracket 201 attaches to angle bracket 203 on sliding housing 137*a*, as shown in FIG. 10. An identical arrangement is provided for sliding housing 137*b*. The adjustment means for cam follower 192 allows fine control of the motion of the sliding housings 137*a* and 137*b* as the cam surface can be intersected earlier or later during the rotation of vacuum support beam 147 relative to the barrel cams 189 and 191 by adjusting the cam follower closer to or farther from the helical cam surface via slots 199. This adjustment controls the total distance traveled by the sliding housings due to camming action thus allowing different size hinges to be formed by the compressing action of the sliding housings, highlighting further the versatility of the preferred embodiment of the apparatus according to the invention.

ROTARY TABLE AND PREFOLDING MEANS (FIGS. 1, 2, 11–14 and 18)

Transfer means 105 and 107 move carton blanks 21 from respective feed magazines 5 and 7 to a rotary table 206, having a support surface 204, the table being located between the twin feed magazines. Rotary table 206 is oriented horizontally and rotates about a vertical axis by means of motor 208. The table is capable of revolving in one direction or the other continuously or intermittently, or, preferably, the table can also oscillate between two positions 90π apart, dwelling in either position as required for carton formation.

As best shown in FIG. 2, rotary table 206 has four apertures 210*a*, 210*b*, 210*c* and 210*d* in its support surface 204. The apertures provide the means by which a carton blank is folded into a carton, as will be described in detail later. Mounted on rotary table 206 are prefolding means, shown in FIG. 14, comprised of angled plows 220, straight plows 221, guide fins 223 and horizontally projecting bosses 225. The table further has carton blank retaining means mounted on its surface, comprising threaded studs 227. The detailed structure and function of each of these components will now be described for the formation of one carton, it being understood that two cartons are formed simultaneously and identically by the apparatus.

After adhesive has been applied to the adhesive receiving regions 205, 207, 209, 211, 213, 215, 217 and 219 of carton blank 21 by the adhesive application means 49, the transfer means 105 strips the carton blank from feed magazine 5, folds clamshell hinge 102 while rotating the carton blank from a vertical to a horizontal orientation, as previously described. The four apertures 210*a*–210*d* are arranged in rotary table 206 alternately parallel and anti-parallel to each other, as seen in FIG. 2. Alternate parallel apertures such as 210*a* and 210*c* are further arranged in the table such that they align with transfer means 105 and 107 at respective carton blank receiving stations to accept a carton blank from the transfer means in the horizontal position. Furthermore, the alternate anti-parallel apertures 210*b* and 210*d* will also align with the transfer means upon a 90° rotation of the rotary table. Thus, with apertures 210*a* and 210*c* aligned as shown in FIG. 2, the carton blank 21 is brought into overlying arrangement with aperture 210*a* by transfer means 105 as seen in FIG. 13. (The action is identical for transfer means 107 and therefore will not be described.)

Figure 14:
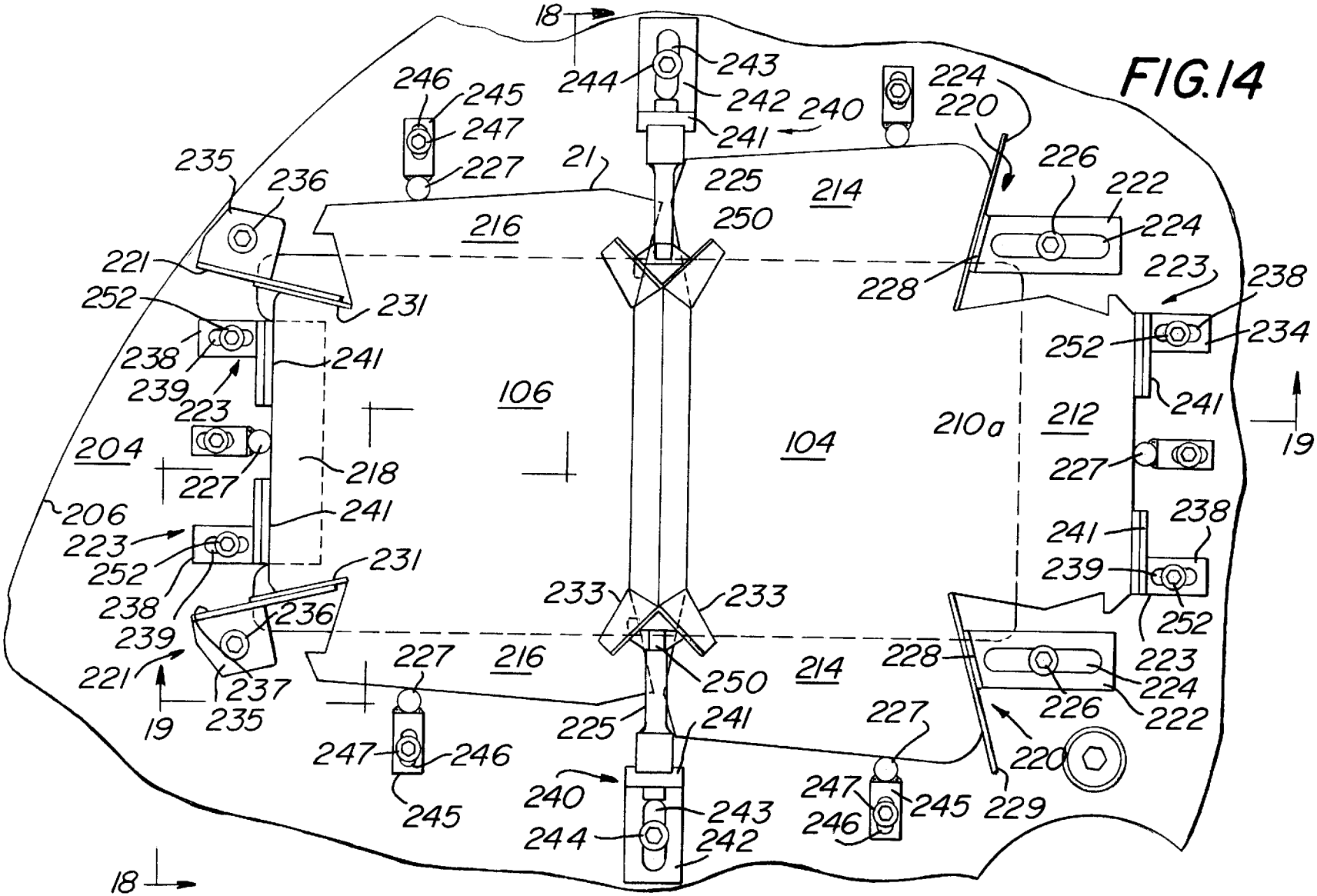
FIG. 14 shows a detailed view of aperture 210*a* with carton blank 21 in overlying relationship.

As the carton blank 21 is brought into overlying arrangement with aperture 210*a* as seen in FIG. 14 angled plows 220 engage bottom end tabs 229 folding the tabs upwardly along predetermined fold lines 230. Angled plows 220 are preferably of thin gauge steel and have a mounting foot 222 with a slot 224 which mounts on the surface of table 206 via bolt 226. Slot 224 allows for translational adjustment of the plow relatively to the carton blank thus controlling the degree of prefolding of the bottom end tabs seen in FIG. 16. Sliding angled plows 220 away from the aperture decreases the angle of bend given to tabs 229, sliding angled plow toward the aperture increase the angle of bend. The plow face 228 stands upright from the foot 222 and engages the tab 229 forcing the bend along predetermined fold line 230. Face 228 is angled to mate with tab 229, but rotational adjustment is of course possible by rotating the plow mounting foot about bolt 226 to exactly match the tab angle.

Similarly, straight plows 221 have a mounting foot 235 secured to table 206 by bolt 236. Straight plows 221 are angularly adjustable about bolt 236 by rotating the plow and tightening the bolt to secure the plow at a desired angle. Straight plow face 237, extending from foot 235, engages top end tabs 231 of carton blank 21 and causes them to fold along predetermined fold lines 232 when the blank is transferred to the table 206, shown in FIGS. 14 and 16.

Figure 19:
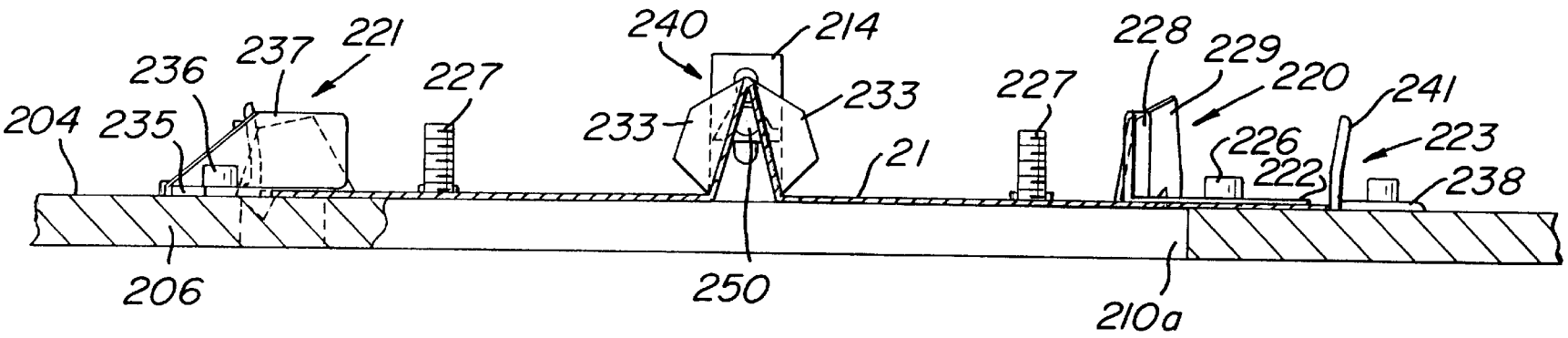
FIG. 19 shows a side view of carton blank 21 overlying aperture 210*a;*

Guide fins 223 are arranged at either end of the apertures and are comprised of a mounting foot 238 with a slot 239 for translational adjustment, fixed in place by bolts 252. As best seen in FIG. 19, the face 241 of the guide fin 223 extends upwardly from the mounting foot 238 and the tip of the face is angled outwardly from the vertical portion inducing a funnelling effect, guiding the carton blank 21 into proper alignment with the aperture 210*a*. Slots 239 provide for translational adjustment of the guide fins 223 providing a fine adjustment for tuning the alignment of the carton blanks overlaying the apertures. The guide fins 223 engage the carton blank along the top and bottom ends 218 and 212, respectively, and help maintain the clamshell hinge 102 in the folded configuration once the transfer means has released the carton blank.

Projecting bosses 225 comprise the final prefolding means. The bosses 225 extend horizontally from the vertical leg 241 of angle bracket 240. Angle bracket 240 has a slot 243 in its horizontal leg 242 through which bolt 244 secures the angle bracket to table 206. By means of the slots 243, the bosses 225 may be translationally adjusted toward or away from the aperture, thus controlling the degree of prefolding of the side tabs 233.

The projecting bosses 225 engage carton blank 21 at side tabs 233 which flank hinge 102 and cause the side tabs to fold along predetermined fold lines 234, as seen in FIGS. 14 and 16–19. A winged tip 250 facilitates tab engagement, augmenting the width of the projecting boss to better prefold the tabs 233. The bosses can also be adjusted vertically by means of slots 248 in vertical leg 241. The vertical adjustability also allows the degree of tab folding to be controlled, with the higher settings of the bosses producing a proportionally greater tab folding outwardly than the lower settings.

Prefolding of the carton blank, as shown in FIGS. 14, 16, 18 and 19, prior to carton formation is important to ensure the consistent manufacture of quality cartons with strong adhesive joints which hold the carton shape once the carton is discharged from the carton forming apparatus and when the carton is used. FIG. 17 shows a formed carton 100 wherein the adhesive receiving regions 205, 207, 209, 211, 213, 215, 217 and 219 are bonded to their respective mating regions. Proper adhesive joints, as for example, between adhesive receiving region 217 (on bottom end 212) and tab 229, require first that tab 229 and bottom end 212 engage with the adhesive between their mating surfaces, and second, mate only as the carton assumes its final shape. If bottom end 212 folds slightly before tab 229 the adhesive receiving region 217 will be on the outside of the carton and no bonding between tab and bottom end will occur, resulting in a reject carton. If tab 229 is in sliding contact with bottom end 212 as the carton blank is folded the adhesive is wiped from the area and a weak, inadequate adhesive bond results which causes the carton to fall apart in use.

Figure 16:
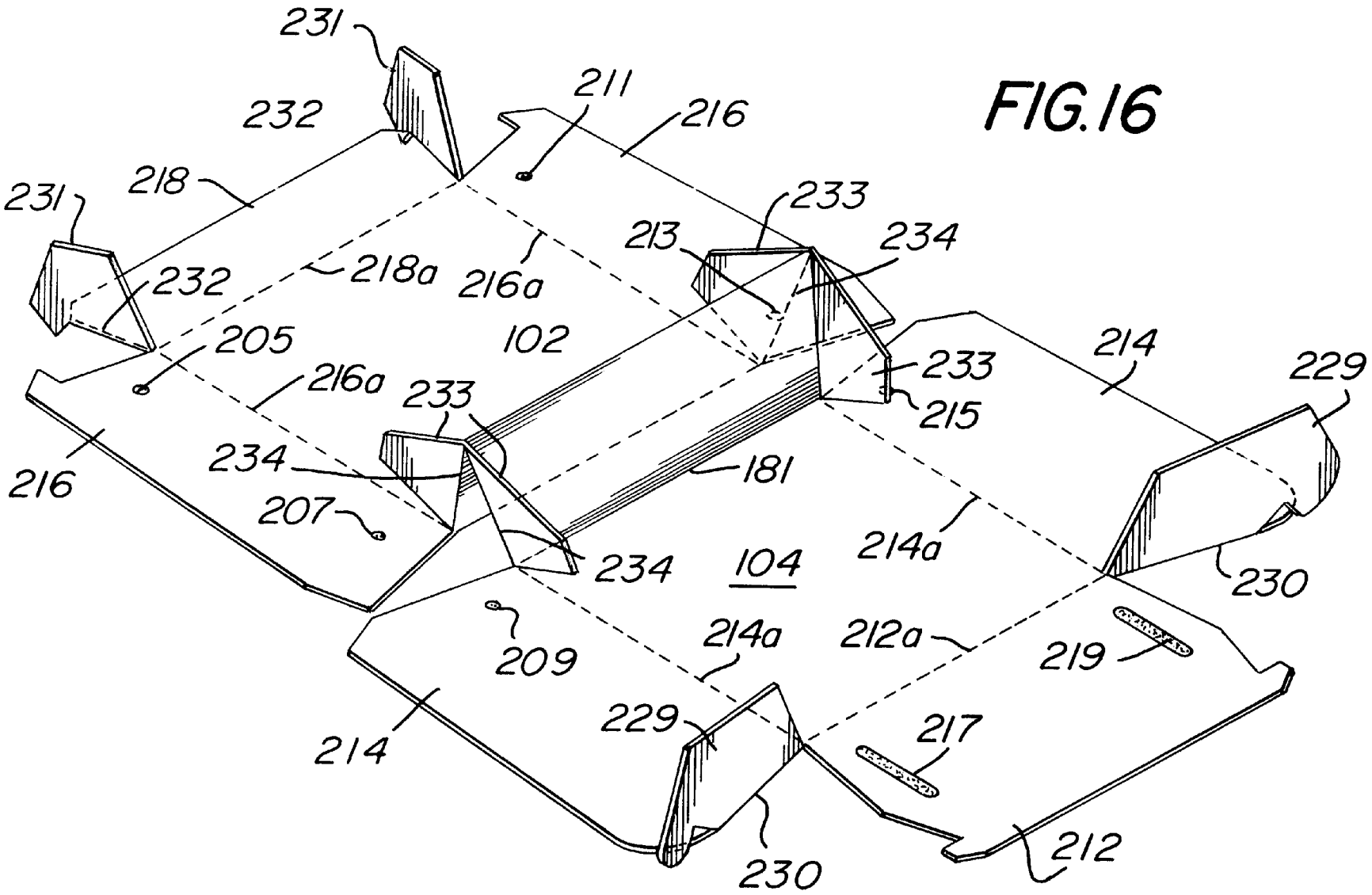
FIG. 16 shows an isometric view of carton blank 21 depicting prefolding of the carton tabs.

FIG. 14 further shows the significance of prefolding according to the invention. Carton blank 21 is shown overlying aperture 210*a* on table 206 after the operation of both the adhesive application means and the transfer means. Carton folding is effected by forcing the carton blank 21 through the aperture 210*a*, the side walls 214, 216 and the ends 212 and 218 engaging the edges of aperture 210*a* which are relatively spaced to cause the side walls and ends of the carton blank to fold along associated predetermined fold lines 212*a*, 214*a*, 216*a* and 218*a*, thus forming the carton seen in FIG. 17. Without the prefolding step as shown in FIG. 16, the tabs may not be folded by the aperture edge before the side walls and ends of the carton are folded, causing the tab to end up on the inside of the carton allowing the adhesive to bond the tab to the mating side wall or end and sliding contact between a tab and a carton side wall or end may occur causing a wiping of the glue from the region and preventing the formation of a strong adhesive joint between tab and side wall or end. Prefolding allows the necessary prepositioning of the tabs so that strong adhesive bonds are formed in the carton folding step when the mating regions of the side walls and the ends are joined to the tabs.

Threaded studs 227 comprise the retaining means associated with each aperture. The threaded studs 227 are attached to a mounting foot 245 having a slot 246 through which bolts 247 attaches the studs to table 206. Slot 246 naturally permits translational adjustment of the studs 227 toward or away from the aperture, allowing the studs to engage the periphery of the carton blank 21 with greater or lesser force to retain the blank to the table. Retention of the blank depends on the blank periphery intimately engaging the threads of the studs 227, and it is therefore important that the studs be adjustable to control the degree of interference between the blank periphery and the threads, the adjustability further allowing an operator to compensate for variations in box blank size, or to conveniently adapt the apparatus to a different blank size or shape.

FORMING RAMS (FIGS. 1, 2, 20 and 21)

Actual folding of a carton blank into the carton, shown in FIG. 17, is effected by reciprocating carton forming rams 249 and 251 shown in FIGS. 1 and 2. The carton forming rams are mounted on tubular frame member 6 at carton blank forming stations directly above the rotating table 206 and the rams are aligned with alternate parallel apertures 210*b* and 210*d* as shown in FIG. 2. Note that rotation of the table through 90° will bring the other set of apertures, 210*a* and 210*c* in alignment with the rams while simultaneously bringing apertures 210*b* and 210*d* into alignment with the transfer means 105 and 107. Thus in the flow of carton blanks through the apparatus the rams can operate to fold cartons while the transfer means move the next carton blanks into position on the table.

Figure 20:
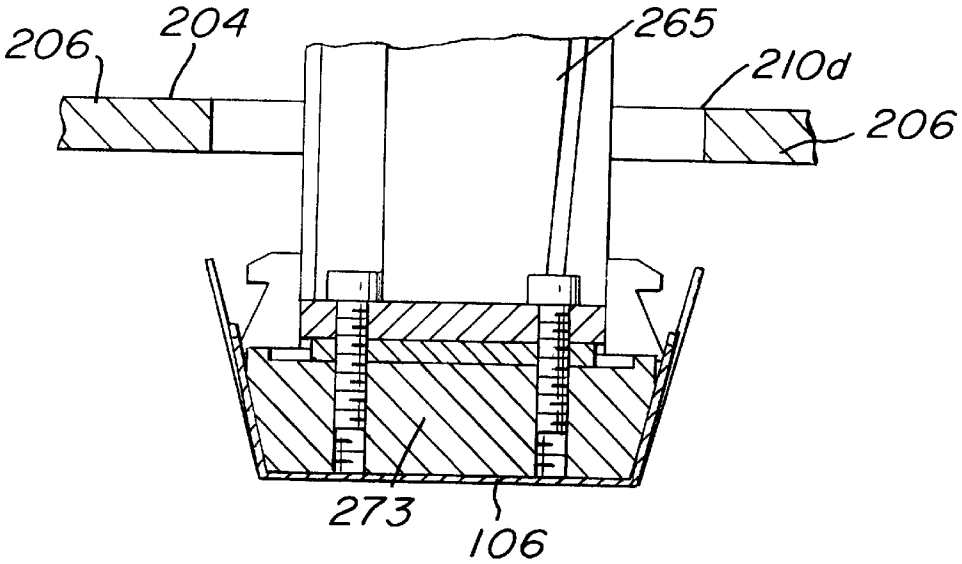
FIG. 20 shows a sectional end view of a forming ram engaging a carton blank.
Figure 21:
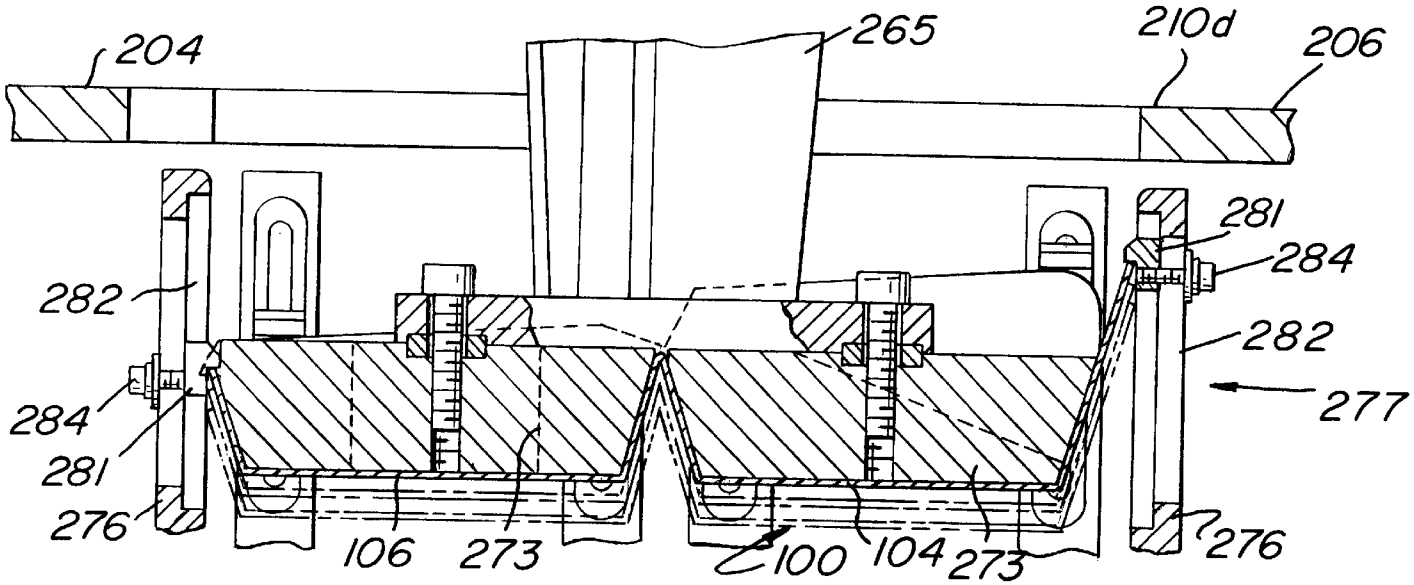
FIG. 21 shows a sectional side view of a forming ram engaging a carton blank.

A common motor 253 coupled to a reducing gearbox 255 turns two cranks 257 and 259 on a common shaft 258. Each crank is connected to a respective link bar, crank 257 to link bar 261 and crank 259 to link bar 263, and each link bar is connected to a respective ram body, link bar 261 to ram body 265 and link bar 263 to ram body 267. Ram body 265, slides in a vertically oriented track 269, and ram body 267 slides in vertically oriented track 271. Both tracks are suspended from frame member 6. As the cranks 257 and 259 turn the respective link bars 261 and 263 the link bars cause the respective ram bodies 265 and 267 to execute vertical reciprocal motion guided on respective tracks 269 and 271. Ram body 265 has a shoe 273 mounted at its lower end, similarly, ram body 267 has a shoe 275. With the downward motion of the ram bodies the shoes engage the carton blank top 106 and bottom 104, as shown in FIGS. 20 and 21 for ram body 265 and shoe 273. The rams force the carton blank through the apertures in table 206, the apertures folding the carton blank into the carton 100 shown in FIG. 17. FIGS. 20 and 21 show ram 265 forcing a carton blank through aperture 210*d* in table 206.

HOLDING MEANS (FIG. 1)

Preferably, each ram discharges its carton from the table into respective holding means comprising chambers or cages, shown in FIG. 1 as 277 and 279. A holding cage or chamber is arranged directly beneath each ram and cooperates with a ram to receive the formed carton 100. The cage structures are comprised of elongated members 276 bolted together to form the cage structure and are dimensionally spaced so as to hold the carton in its shape, cartons also nesting one inside the other, as seen in FIGS. 1 and 21. Retaining barbs 281 project from cage members 276 near the interface between the cage and the ram as seen in FIG. 21 for cage 277. Retaining barbs 281 engage the carton 100, preventing the ram from withdrawing the carton on the upstroke of the ram. The retaining barbs are adjustable by means of slots 282 in members 276 and are secured by bolts 284 at a desired vertical position along slots 282 to engage cartons 100. The adjustability feature allows the cage to be used with a wide variety of carton shapes and sizes.

The cages 277 and 279 are of sufficient length that the cartons remain within the cage long enough for the adhesive to set. Upon discharge from the cage the cartons are capable of holding their shape without any support. The formed nested cartons 100 are pushed through the cages by the rams, the entire line of cartons advancing with each downward ram stroke as another carton is added to the stack. The cartons 100 are conducted on chutes (not shown) from the cages to be packaged for shipment to end users.

Figure 22B:
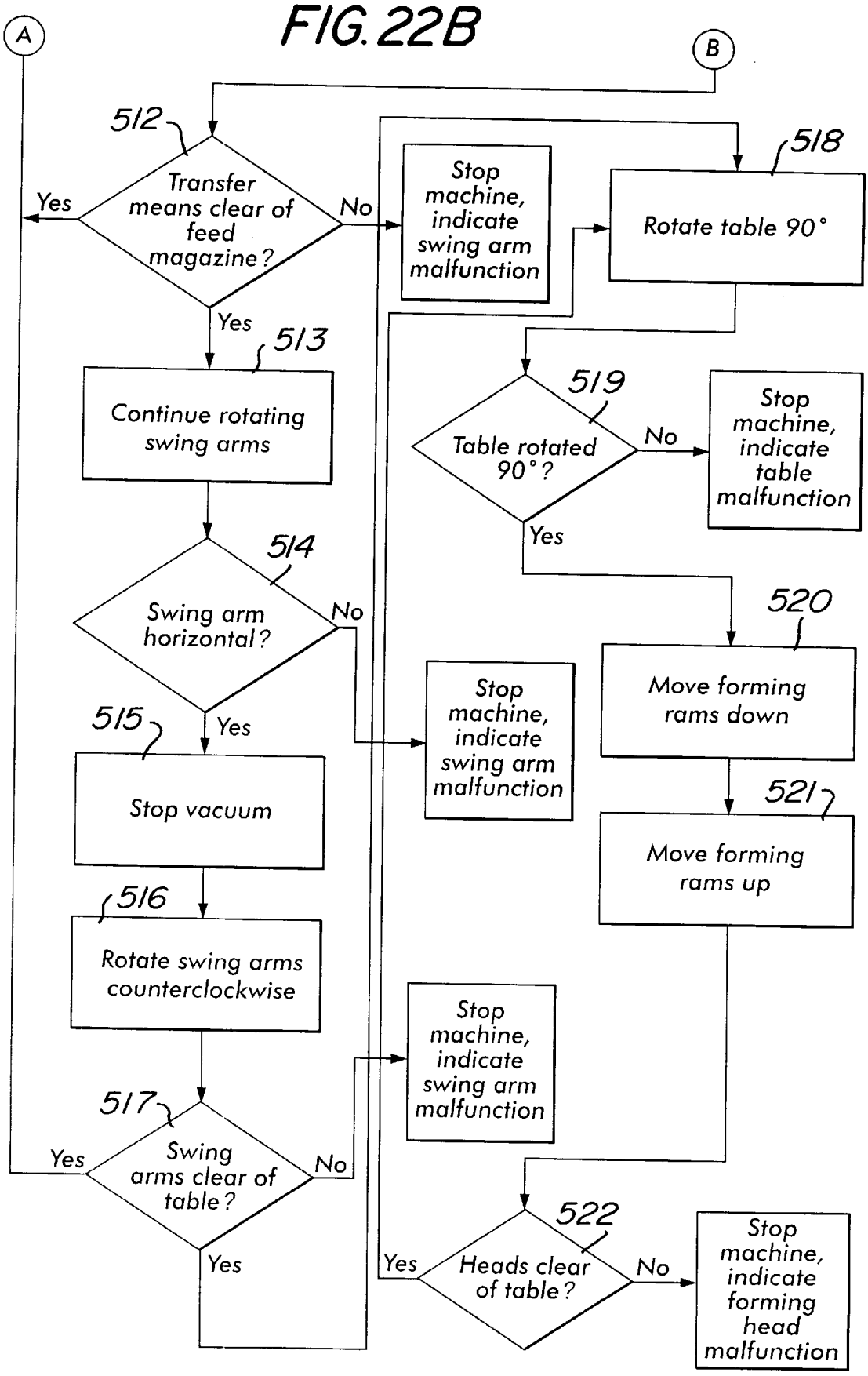
FIG. 22 depicts a flow diagram describing the logic of the computer software controlling the machine.
Figure 23:
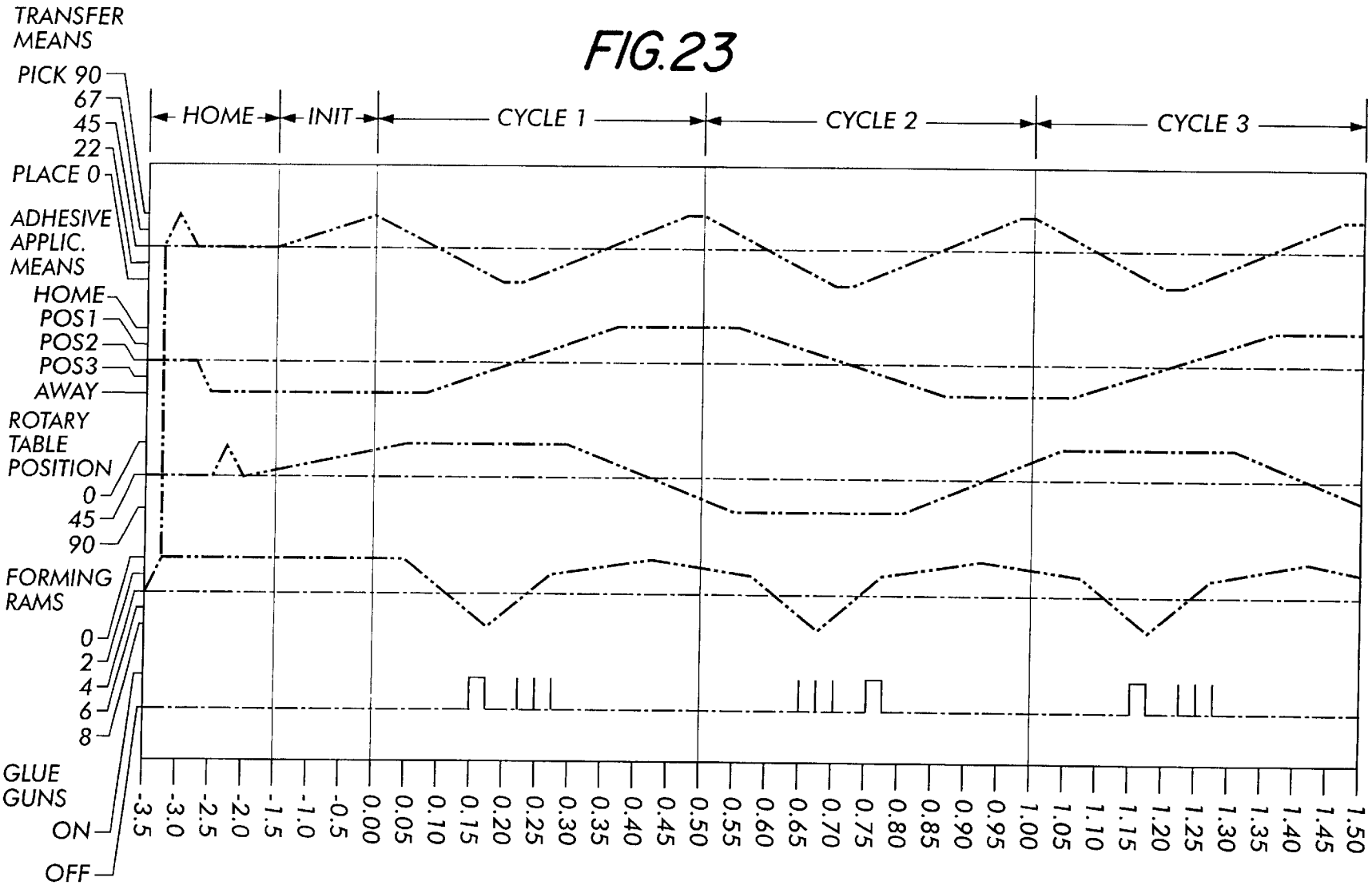
FIG. 23 depicts a timing diagram showing the synchronization of the various components of the carton forming apparatus according to the invention.

CONTROL SYSTEM (FIGS. 1, 22 and 23)

In the preferred embodiment of the apparatus a computer 301 with resident software 303 controls the carton forming apparatus by issuing commands and receiving feedback signals over cable 305. The software 303 is capable of issuing various commands to the components of the apparatus which effect the operation of the components. The software controls operation of the glue guns 53 and 55 to shoot a glue stream or a glue dot; controls movement to the glue guns vertically closer together or farther apart by activating air cylinder 71 which turns spline shaft 73 rotating pulley 63 which moves belt 61; controls traverse of the glue guns laterally across the face of a carton blank 21 by activating motor 91 which turns screw shaft 89 which engages a ball screw in traversing housing 69; rotates swing arms 111 by activating motor 117 which turns keyed shaft 173; causes rotatory table 206 to rotate by activating motor 208; causes forming heads or rams 249 and 251 to engage carton blanks 21 on rotating table 206 by activating motor 253, turning cranks 257 and 259 connected to link bars 261 and 263 causing reciprocal motion of the ram bodies 265 and 267.

Furthermore, software 303 can receive and interpret signals from the components such as optical sensors 93 and 95 which tell the software whether the glue guns have successfully operated when commanded by detecting the presence or absence of reflected light from the glue stream. Sensors associated with air cylinder 71 and motors 91, 117, 208 and 253 send feedback signals to the software which indicate the relative rotational positions of the spline shaft 73, the screw shaft 89, the keyed shaft 173, rotary table 206 and cranks 257 and 259, respectively. The relative rotational positions of these components is correlated with the relative positions of the glue guns 53 and 55, the position of the traversing carriage 69, the position of swing arms 111, the position of rotary table 206 and the position of forming heads or rams 265 and 267 respectively. The software uses this feedback information to synchronize and coordinate the functioning of the various components so that cartons are formed rapidly and efficiently without the components interfering with each other.

CARTON FORMING APPARATUS OPERATION (FIGS. 22 and 23)

The logic which the software follows in controlling the carton forming apparatus is summarized in FIG. 22 which presents a flow chart of the software operation in the carton forming process. The description which follows pertains to the operation of both sets of components on opposite sides of the apparatus, but since the operation of the components is identical the operation will be described only in terms of one set of components, it being understood that the steps are simultaneously being executed by the other set as well.

In the first step, described in box 501, the apparatus is placed into an initial configuration comprised of moving the forming ram up to maximum height above the rotary table, orienting the swing arms 111 of the transfer means at a 45° angle, rotating the rotary table so that its apertures align with forming ram 265 and traversing glue guns 53 and 55 in adhesive application means 49 as far as possible toward the motor 91 on the screw shaft 89.

In the next step denoted in box 502 the glue guns 53 and 55 are traversed across the face of the first carton blank to be processed, carton blank 21, held in magazine 5. The glue guns traverse to the opposite side of the screw shaft 89 from motor 91. As they traverse the first carton blank the glue guns 53 and 55 are positioned vertically by the software controlling air cylinder 71 turning pulley 63 and pulley belt 61 to align the glue guns with adhesive receiving regions on carton blank 21 as described in box 503. The glue guns are commanded by the software to project an adhesive stream at predetermined locations on carton blank 21 in magazine 5 as they bear on the target regions as indicated in box 504. FIG. 3 illustrates typical adhesive receiving locations on carton blank 21 marked by 205, 207, 209 and 217 for glue gun 55 and 211, 213, 215 and 219 for glue gun 53. The software aligns glue guns 53 and 55 vertically as they pass adhesive receiving regions 217 and 219 and orders a glue stream of relatively long duration causing a glue stripe to be placed on the carton blank. The software realigns the glue guns 53 and 55 vertically to correspond to the locations of the remaining adhesive receiving regions 205, 207, 209, 211, 213 and 215 and commands a glue stream to be projected as the glue guns bear on these points. These glue streams are of relatively short duration, producing glue dots on the carton blank 21. The software receives feedback signals from air cylinder 71 and motor 91 which tell the software the horizontal and vertical position of the glue guns relative to the carton blank in order that the software can issue the glue stream projection commands at the proper moment. Feedback also is returned from optical sensors 93 and 95 as indicated in box 505 which confirm whether a glue stream has been detected. If no glue stream is detected the machine is stopped and the software indicates to the operator at the computer 301 that a problem has arisen with the glue guns. The problem could be that the glue guns are clogged, or that the glue reservoir is exhausted, or that the glue guns are misaligned and not projecting glue to the correct predetermined location on the carton blank. To avoid the clogging failure, it has been found to be of advantage to apply the relatively longer duration glue stream after the shorter glue stream, as a series of short glue stream applications tends to clog the glue guns more frequently, and a long duration glue stream tends to help clear such glue gun clogs.

Once the software receives the signals that the glue guns have applied adhesive to the first carton blank and traversed clear of the first carton blank (box 506) the software commands the swing arms 111 of transfer means 105 to rotate from their initial 45° position to the vertical position, illustrated in FIG. 11 and indicated in box 507 of the flow chart. A further check on the position of the glue guns is made, as indicated at box 508, and if they have not completely traversed, the ball screw the machine is halted and a malfunction of the traversing carriage is indicated to the operator. Meanwhile, when the software receives the signal that the swing arms have reached the vertical position (box 509) meaning also that the vacuum heads 108 and 109 have engaged the first carton blank (21) the software orders vacuum means 121 to draw a vacuum (box 510). The suction cups 119 gripping carton blank 21 with their resultant suction and the software next commands the swing arms 111 to rotate clockwise (box 511) thereby stripping carton blank 21 from feed magazine 5. Carton blank 21 deforms to pass through the fingers 41 on frame 27. When the software is signaled that the transfer means 105 is clear of the feed magazine 5 (box 512), the software branches in two directions. The first branch commands the glue guns to traverse again, align vertically, and apply adhesive to the second carton blank waiting in the feed magazine 5 much the same way as in the first pass of the glue guns, but from the opposite direction from the first pass. On this pass the glue guns 53 and 55 will encounter adhesive receiving regions in the reverse order from the previous pass and the software 303 will command the glue guns to align with adhesive receiving locations 205–215 and direct the relatively short duration glue streams, then realign again to apply a glue strip at locations 217 and 219. This cycle is repeated by the adhesive application means 49 during machine operation.

The second software branch from box 512 commands swing arms 111 to continue to rotate (box 513), and slider bar 113 engages rotating guide 115 causing vacuum head support bar 147 to rotate counterclockwise. Cam followers 192 on sliding housings 137*a* and 137*b* engage helical cam surfaces 193 and 195 on barrel cams 189 and 191 forcing sliding housings 137*a* and 137*b* together, compressing carton blank 21 held fast by suction cups 119 and buckling carton blank 21 along predetermined fold lines 179, 181, and 183 forming the fold of the clamshell hinge 102 illustrated in FIG. 15. As the swing arms 111 approach the horizontal position shown in FIG. 13 and indicated in box 514, the carton blank 21 is engaged by the prefolding means 220, 221, 225, and retained by the retaining means 223 and 227 on rotary table 206. The carton blank is thereby deposited in alignment with an empty aperture 210*a* in rotary table 206. The software next commands the vacuum means 121 to stop (box 515), releasing the carton blank from transfer means 105, and further commands the swing arms 111 to rotate counterclockwise (box 516) clear of the rotary table (box 516) back to the vertical position of FIG. 11 where the transfer means arrival is timed to strip the second carton blank from feed magazine 5 after adhesive has been applied and the glue guns are again clear of the second carton blank face (box 506).

Meanwhile, once the software receives the signal that the transfer means 105 is clear of the rotary table (box 517), motor 208 is commanded to rotate table 206 clockwise through 90° (box 518), bringing the carton blank 21 held overlying aperture 210*a* beneath forming ram 249. The rotation of the table also brings an empty aperture 210*b* in alignment with the transfer means 105 to accept the second carton blank from the transfer means as well as empty aperture 210*c* in alignment with transfer means 107. When the software receives the signal that the table has rotated to bring the carton blank on the table to the desired position (box 519) the forming ram 249 is permitted to cycle downwardly (box 520), engaging and folding the carton blank into a carton 100 as illustrated in FIG. 17, then discharging the newly formed carton from the rotary table into the holding cage 277 of the apparatus where the carton is held in shape by the cage while the adhesive sets up. This leaves an empty aperture 210*a* in rotary disc ready to receive a third carton blank from the transfer means 105 once the rotary table 206 rotates counterclockwise to bring the empty aperture in alignment with the transfer means 105.

The forming rams continue upwardly now in their cycle (box 521) and once the signal is received by the software that the heads have cleared the rotary table (box 522) the table is rotated counterclockwise through 90° (box 518) to bring the second carton blank beneath the forming ram 249. While the forming ram was engaging the first carton blank as described above, the second carton blank was stripped from the feed magazine 7 by transfer means 107 after the application of adhesive by glue guns 53 and 55 described previously, and the second carton blank was deposited on the rotary table on an empty aperture 210*d* which was brought into alignment with the transfer means 107 when the disc was rotated to bring the first carton blank overlying aperture 210*a* into alignment with the forming ram 249.

Although the rotary table could rotate in the same direction with each command to rotate, it is preferable that the table reciprocate between two positions 90° apart when bringing carton blanks into alignment with the forming rams 249 and 251 and the transfer means 105 and 107. For example, once transfer means 105 and 107 place carton blanks on apertures 210*a* and 210*c* of the rotary table, the table can rotate clockwise 90° to bring these carton blanks beneath forming heads 249 and 251 respectively (see FIG. 2). With the table rotation, empty apertures 210*b* and 210*d* will be aligned beneath transfer means 105 and 107 respectively, ready to accept the next carton blanks. The apertures 210*b* and 210*d* will be empty because forming rams 249 and 251 have formed cartons from the blanks which had been overlying those apertures and discharged the cartons into the holding cages 277 and 279. After forming heads 249 and 251 have folded carton blanks overlying apertures 210*a* and 210*c* and discharged them from the table, the table can rotate counter clockwise through 90°. This will bring now empty apertures 210*a* and 210*c* in alignment with transfer means 105 and 107 to receive the next carton blanks, while simultaneously bringing apertures 210*b* and 210*d*, now with carton blanks from transfer means 105 and 107, beneath forming heads 249 and 251.

A better understanding of the synchronization of the various apparatus components can be obtained from the timing chart shown in FIG. 23. A time scale is shown on the lower most horizontal axis and the operation of each major component of the apparatus is depicted on horizontal axes stacked along the vertical axis. The first (top most) axis indicates the rotational position of the transfer means 105, indicating angular orientation between the horizontal (0°) seen in FIG. 13, and the vertical position (90°) of FIG. 11. The second axis describes the traverse of the adhesive application means 49 between both termini of its travel on screw shaft 89. The third axis indicates the rotational position of the rotary table 206, which cycles between zero and 90° in its operation. The fourth axis shows the vertical location of the forming ram 249 between the ram's highest and lowest points of travel.

For each of these axes motion of the component is indicated by a sloping line, the sign of the slope indicating the sense of the direction of the motion, and a horizontal axis indicates that the component is stationary. Finally, the fifth line indicates operation and duration of the glue guns 53 and 55 firing an adhesive stream.

Assuming the machine has just come out of its initialization phase from time −3.5 to 0.00, we can examine each component at start time 0.00, wherein the transfer means 105 is shown at 90°, as in FIG. 11, just beginning to strip a carton blank from magazine 5. Note that the adhesive application means 49 is stationary (indicated by the horizontal line) waiting for the transfer means to clear the feed magazine 5. The rotary table 206 however is in motion as indicated by the sloping line, bringing its empty apertures in alignment with the transfer means 105 and 107, and its apertures containing prepositioned cartons beneath the forming rams 249 and 251. The forming rams are stationary, as the heads dwell at their zenith awaiting alignment with the rotary table apertures.

From time 0.0 to 0.15 transfer means 105 rotates toward the horizontal, passing through 45° (see FIG. 12) at time 0.10. After dwelling clear of feed magazine 5 until time 0.07, adhesive application means 49 traverses across the carton blank where it reaches the position to begin application of adhesive at time 0.15. The adhesive application position corresponds to adhesive receiving regions 217 and 219 on carton blank 21 shown in FIG. 3, and a relatively long duration of glue gun operation is indicated by the step function pulse from time 0.15 to 0.175 along the fifth axis. Note that the rotary table 206 is stationary during most of this period (horizontal line from time 0.05 to 0.15) which is required because the forming rams are plunging toward their nadirs wherein they engage carton blanks prepositioned manually on the table 206 and force the blanks through the apertures, folding the blanks and discharging them from the table into the holding cages 277 and 279, the point of discharge noted at time 0.175 at which point the forming rams change direction and begin to move upwardly, as indicated by the change of slope from negative to positive. Simultaneously the transfer means 105 is approaching the table, and places a carton blank on the table aligned with an empty aperture at time 0.20. The transfer means dwells in the position, shown in FIG. 13, from 0.20 to 0.225 as the vacuum means 121 is cut off, releasing the blank from the suction cups 119 and allowing the transfer means to begin its rotation back to the vertical, indicated by the sloping line between 0.225 and 0.45. (Transfer means 107 operates identically in parallel with 105.) Note that at time 0.225 the adhesive application means 49 has traversed to a position adjacent to the second adhesive receiving region, denoted by points 209 and 215 on carton blank 21 in FIG. 3. A relatively short burst of adhesive provides a glue dot, as indicated by the narrow pulse along the glue gun operation axis. Adhesive application means 49 continues to traverse and the glue guns align with adhesive receiving regions 207 and 213, and 205 and 211 in turn, each getting a glue dot as indicated at times 0.25 and 0.275 respectively on the glue gun operation axis. (Adhesive application means 51 operates similarly, but in the opposite direction from 49.)

At time 0.30, the rotary table 206 begins its reciprocal motion (opposite slope line indicating a reversal of direction from previous motion) to align empty apertures with the transfer means 105 and 107 and apertures containing carton blanks with the forming rams. By time 0.425, the forming rams 249 and 251 have attained maximum height above the table again and begin their next plunge. The adhesive application means 49 continues its traverse, halting at time 0.375, clear of feed magazine 5, and the transfer means 105 continues upwardly, passing through 45° (FIG. 12) at time 0.35 and to the vertical at time 0.46 where it dwells until time 0.50 to engage the next carton blank in the stack in feed magazine 5. As indicated in FIG. 23, this completes the first machine cycle, and the component operations described are repeated in subsequent machine cycles as further indicated in the Figure.

Although the above description refers to the formation of corrugated clamshell containers for the food service industry, it is to be understood that in application, the invention is not limited to these types of containers or this industry. The versatility of the design makes the apparatus suitable for a wide range of different types of containers of varied size and material composition, useable in various contexts and environments.

We claim:

1. Apparatus for forming cartons from precut carton blanks, said carton blanks each being foldable along predetermined lines to form a carton having a bottom and side walls, said blanks having a plurality of adhesive receiving regions and mating regions interengaged upon carton blank folding along said predetermined lines, the apparatus comprising:

a support frame;

a feed magazine mounted on said support frame for supply of a stack of unfolded carton blanks;

adhesive application means for sequential application of adhesive to said adhesive receiving regions of a carton blank in said magazine at an end of said stack, said adhesive application means including an applicator arranged facing said blank and traversing means mounted on said support frame for moving said applicator in two mutually perpendicular directions laterally of the face of said blank to each of said adhesive receiving regions thereon;

control means for operation of said applicator to apply adhesive to said adhesive receiving regions upon movement of said applicator wherein said control means provide adjustment of said applicator to accommodate differently configured carton blanks thereto;

carton blank folding means comprising a table mounted on said support frame, said table having a support surface having an aperture extending therethrough, said aperture having side edges relatively spaced to interengage the side walls of a carton deposited with the carton blank bottom overlying said aperture;

means mounted on said support frame for transferring carton blanks from the end of said stack following adhesive application by said adhesive application means to said support surface with the bottom of the blank in aligned overlying relationship with said aperture;

a reciprocable carton forming ram mounted on said support frame and relatively movable into said aperture and engagable with the carton blank bottom and cooperating with said aperture side edges to fold said blank along said predetermined lines so as to form said carton with said adhesive regions in interengagement with said mating regions; and means engagable with said carton bottom for discharge of a formed carton from said aperture.

2. Apparatus according to claim 1 further comprising:

prefolding means for prefolding said carton blank comprising a plurality of plows being mounted on said table surface adjacent to said aperture, said plows projecting substantially perpendicularly from said surface and engaging said mating regions on said carton blank deposited overlying said aperture, said plows causing said mating regions to fold along predetermined lines to a predetermined angular position relatively to said carton blank;

retaining means for holding said blank in a prefolded position overlying said aperture, said retaining means comprising a plurality of guide fins mounted on said table adjacent to said aperture projecting substantially vertically from said table, each of said guide fins having a tip angled outwardly away from said aperture, said guide fins engaging said carton blank at its periphery when said carton blank is deposited overlying said aperture; and said retaining means further comprising a plurality of threaded studs projecting substantially perpendicularly from said table, said studs mounted adjacent to said aperture, said threads engaging peripheral edges of said carton blank and holding said carton blank in overlying relationship with said aperture.

3. Apparatus according to claim 2 in which said prefolding means further comprises projecting bosses having mounting brackets, said bosses being mounted adjacent to said aperture on said table, said bosses extending substantially horizontally and spaced above said table on said brackets and engaging said mating regions on said carton blank deposited overlying said aperture, said bosses prefolding said mating regions along said predetermined lines to a predetermined angular orientation relatively to said carton blank.

4. Apparatus according to claim 1 further comprising:

means for holding said adhesive receiving regions interengaged with said mating regions upon carton blank folding allowing said adhesive to set, said holding means comprised of a plurality of elongated members arranged in parallel spaced apart relationship forming a chamber sized to receive said cartons subsequent to discharge from said aperture, said cartons nesting one inside another within said chamber in their folded shape.

5. Apparatus according to claim 1, wherein said applicator comprises a nozzle spaced apart from the surface of said blank for projecting a stream of adhesive onto said adhesive receiving regions of said blank.

6. Apparatus according to claim 5, further comprising a sensor mounted on said traversing means for sensing the discharge of adhesive from said nozzle.

* * * * *

UNITED STATES PATENT AND TRADEMARK OFFICE

CERTIFICATE OF CORRECTION

PATENT NO. : 5,980,440

DATED : November 9, 1999

INVENTOR(S) : Mitman et al

It is certified that error appears in the above-identified patent and that said Letters Patent are hereby corrected as shown below:

Column 5, line 26, change "FIG. 22 depicts" to --FIGS. 22A and 22B depict--

Column 15, line 54, after the heading CONTROL SYSTEM, change "(FIGS. 1, 22 and 23)" to --(FIGS. 1, 22A, 22B and 23)--

Column 16, line 31, after the heading CARTON FORMING APPARATUS OPERATION, change "(FIGS. 22 and 23)" to --(FIGS. 22A, 22B and 23)--

Column 16, line 34, change "FIG. 22" to --FIGS. 22A and 22B--

Column 20, Claim 1, line 67, delete "thereto"

Signed and Sealed this

Third Day of April, 2001

*Attest:*

Nicholas P. Godici

NICHOLAS P. GODICI

*Attesting Officer*

*Acting Director of the United States Patent and Trademark Office*